US007261989B2

(12) United States Patent
Sugiura et al.

(10) Patent No.: US 7,261,989 B2
(45) Date of Patent: Aug. 28, 2007

(54) TONER FOR DEVELOPING ELECTROSTATIC IMAGES, DEVELOPER, IMAGE FORMING METHOD, AND IMAGE FORMING APPARATUS

(75) Inventors: Hideki Sugiura, Fuji (JP); Satoshi Mochizuki, Numazu (JP); Yasuaki Iwamoto, Numazu (JP); Yasuo Asahina, Numazu (JP); Hisashi Nakajima, Numazu (JP); Tomoyuki Ichikawa, Numazu (JP); Shinya Nakayama, Numazu (JP); Masayuki Ishii, Numazu (JP); Tomoko Utsumi, Ebina (JP); Koichi Sakata, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/400,375

(22) Filed: Apr. 10, 2006

(65) Prior Publication Data

US 2006/0240351 A1 Oct. 26, 2006

Related U.S. Application Data

(63) Continuation of application No. PCT/JP2004/014924, filed on Oct. 8, 2004.

(30) Foreign Application Priority Data

Oct. 10, 2003 (JP) ..... 2003-351813

(51) Int. Cl.
*G03G 9/00* (2006.01)

(52) U.S. Cl. ..... 430/108.11; 430/108.15; 430/137.1; 430/137.17; 430/120; 399/252

(58) Field of Classification Search ..... 430/108.11, 430/108.15, 137.1, 137.17, 120; 399/252
See application file for complete search history.

(56) References Cited

U.S. PATENT DOCUMENTS 5,998,080 A 12/1999 Ohno et al.

(Continued)

FOREIGN PATENT DOCUMENTS

JP 4-172366 6/1992

(Continued)

OTHER PUBLICATIONS

Machine translation of JP 2000-310882.*

(Continued)

*Primary Examiner*—Mark A. Chapman
(74) *Attorney, Agent, or Firm*—Oblon, Spivak, McClelland, Maier & Neustadt, P.C.

(57) ABSTRACT

The object of the present invention is to provide a toner which has sufficiently high chargeability and less toner spent to a carrier or the like even when several tens of thousands of image sheets are output, is capable of keeping high-charge property and flowability without causing substantial background smear or toner fogging, excels in low-temperature fixing property and hot-offset property, and has a wide range of fixing temperature as well as to provide a developer, an image forming apparatus, a process cartridge, and an image forming method using the toner for developing electrostatic images. The toner of the present invention comprises a colorant, and a resin, and a fluoride compound, in which the fluoride compound exists on the surfaces of toner particles, and the atomic number ratio (F/C) of fluoride atoms to carbon atoms existing on the surfaces of the toner particles is 0.010 to 0.054.

16 Claims, 7 Drawing Sheets

U.S. PATENT DOCUMENTS

| | | | | |
|---|---|---|---|---|
| 6,824,945 | B2 | 11/2004 | Emoto et al. | |
| 6,936,390 | B2 | 8/2005 | Nanya et al. | |
| 7,074,535 | B2 * | 7/2006 | Saito et al. | 430/108.11 |

FOREIGN PATENT DOCUMENTS

| | | |
|---|---|---|
| JP | 4-204551 | 7/1992 |
| JP | 5-333587 | 12/1993 |
| JP | 05-341617 | 12/1993 |
| JP | 5-346686 | 12/1993 |
| JP | 2537503 | 7/1996 |
| JP | 09-043909 | 2/1997 |
| JP | 09-258474 | 10/1997 |
| JP | 10-73958 | 3/1998 |
| JP | 10-142840 | 5/1998 |
| JP | 11-133657 | 5/1999 |
| JP | 11-133667 | 5/1999 |
| JP | 2942588 | 6/1999 |
| JP | 3102797 | 8/2000 |
| JP | 2000-292973 | 10/2000 |
| JP | 2000-310882 | 11/2000 |
| JP | 3141783 | 12/2000 |
| JP | 3407521 | 3/2003 |
| JP | 2003-270839 | 9/2003 |
| JP | 2003-280269 | 10/2003 |
| WO | WO 2002/056116 | 7/2002 |

OTHER PUBLICATIONS

Machine translation of JP 10-142840.*

Machine translation of JP 10-73958.*

Takao Ishiyama et al.; "Feature of Evolved Toner Production Process and Possibility";Proceedings fo the Symposium on Toner Charging- The Technical Overveiw and Assignments; pp. 21-28, Jul. 29, 2002.

* cited by examiner

TONER FOR DEVELOPING ELECTROSTATIC IMAGES, DEVELOPER, IMAGE FORMING METHOD, AND IMAGE FORMING APPARATUS

CROSS-REFERENCE TO RELATED APPLICATIONS

This is a continuation of Application PCT/JP2004/014924, filed on Oct. 8, 2004.

BACKGROUND OF THE INVENTION

1. Field of the Invention

The present invention relates to a toner for developing electrostatic images, a method for producing the toner for developing electrostatic images, a developer for developing electrostatic images, an image forming method, an image forming apparatus, and a process cartridge using the toner for developing electrostatic images.

2. Description of the Related Art

In electrophotographic apparatuses, electrostatic recording apparatuses, or the like, a toner is made to adhere on a latent electrostatic image formed on a photoconductor, the toner is transferred onto a transferring material, and the toner is fixed onto the transferring material by means of heat to thereby form a toner image. In full-color image formation, a color image is typically reproduced using four-color toners of black, yellow, magenta, and cyan, the image is developed for each of the four-color toners, respective toner layers of the four-color toners superimposed on a transferring material are fixed at a time by heating to thereby obtain a full-color image.

From the standpoint of users who are generally familiar with printed materials, images obtained with a full-color copier are not of satisfactory level. Further higher quality image formation satisfying high-fineness and high-resolution levels which are close to those of photographs and printing is demanded. It is known that a toner having a small particle diameter and a narrow particle size distribution is used in high-quality image forming of electrophotographic images.

Conventionally, electronic or magnetic latent images are developed using a toner. A toner used for developing electrostatic images is colored particles in which a colorant, a charge controlling agent, and other additives are contained in a binder resin, and there are two main types of methods for producing such a toner, i.e. pulverization method and polymerization method. In pulverization method, a colorant, a charge controlling agent, an offset inhibitor, or the like are fused and mixed in a thermoplastic resin to be uniformly dispersed therein, the obtained composition is pulverized, and the pulverized toner particles are classified to thereby produce a toner. According to pulverization method, a toner having rather excellent properties can be produced, however, there are limitations on selection of materials for the toner. For example, a composition to be obtained by fusion and mixture of toner materials needs to be pulverized and classified through use of an economically available apparatus. Because of the needs, it leaves no alternative but to make a fused and mixed composition sufficiently brittle.

For the reason, when the composition is actually pulverized into particles, a wide range of particle size distribution is easily formed. When a copied image having high-resolution and high-tone is tried to be obtained, for example fine power particles having a particle diameter of 5 μm or less and coarse powder particles having a particle diameter of 20 μm or more must be removed in a classification process, and thus there is a disadvantage that the yield is extremely low. In addition, when a pulverization method is employed, it is difficult to uniformly disperse a colorant, and a charge controlling agent in a thermoplastic resin. Ununiform dispersion of compounding ingredients adversely affects the flowability, developing property, durability, image quality of the toner.

In recent years, in order to overcome the problems in these pulverization methods, for example, toner particles are obtained by suspension polymerization method (see Japanese Patent Application Laid-Open (JP-A) No. 09-43909). However, the toner particles obtained by suspension polymerization method are spherically shaped, and there is a disadvantage that the toner particles are poor in cleaning ability. In developing and transferring an image having a low image area ratio, the amount of residual toner particles after transferring is small, and thus there is no problem with cleaning ability, however, an image having a high image area ratio such as a photographic image, further, a toner with which an untransferred image is formed due to a sheet-feeding failure or the like may occur as a residual untransferred toner on a photoconductor, causing background smear of image when such a residual untransferred toner is accumulated.

In addition, it causes smears on charge rollers or the like which contact-charges the photoconductor, which disenables exerting of its intrinsic chargeability thereof.

On the other hand, a method for obtaining toner particles formed in indefinite shape by associating resin fine particles obtained by an emulsion polymerization method each other has been disclosed (see Japanese Patent (JP-B) No. 2537503). However, in the toner particles obtained by the emulsion polymerization method, a large amount of surfactants remains not only on the surface of the toner particles but also in the inside of the toner particles even when they have been subjected to a washing treatment, which causes impaired environmental stability of toner charge, a widen charge amount distribution, and image defective due to smears of the obtained images. There are problems that the remaining surfactants smear the photoconductor, charge rollers, developing rollers, or the like, which disenables exerting of its intrinsic chargeability.

On the other hand, in a fixing step according to a contact-heat method in which fixing is performed by means of heating members such as a heat roller, releasing property of toner particles against the heating members, which is hereinafter referred to as anti-offset property, is required. Anti-offset property can be improved by making a releasing agent reside on surfaces of toner particles. In view of this tendency, Japanese Patent Application Laid-Open (JP-A) No. 2000-292973 and Japanese Patent (JP-B) No. 3141783 respectively disclose a method in which anti-offset property is improved by making resin fine particles reside not only in toner particles but also are unevenly distributed onto surfaces of the toner particles. However, this method involves a problem that the lower limit fixing temperature is raised, causing insufficient low-temperature fixing property, i.e. energy-saving fixing property.

In the method in which resin fine particles obtained by emulsion polymerization method are associated each other to thereby obtain a toner formed in indefinite shape, the following problems are caused. In other words, in the case where fine particles of a releasing agent are associated with toner particles in order to improve anti-offset property, the fine particles of the releasing agent are substantially taken into the toner particles, resulting in discouraging improvement in anti-offset property with sufficiency. Since resin fine particles, fine particles of releasing agents, fine particles of colorants or the like are fused and bound to toner particles randomly to thereby form the toner particles, variations arise in the composition or ratio of contents of the components between the obtained toner particles, and in molecular mass of the resin or the like, resulting in different surface properties between the toner particles, and disenabling of forming images steadily over a long period of time. Further, in a low-temperature fixing system in which low-temperature fixing property is required, there has been a problem that fixing is inhibited due to resin fine particles which reside on surface of the toner, which disenables ensuring the range of fixing temperatures.

On the other hand, a new method of producing a toner called the Emulsion-Aggregation method (EA method) is recently disclosed (Japanese Patent (JP-B) No. 3141783). In this method, toner particles are granulated from polymers which have been dissolved in an organic solvent or the like, contrary to the suspension polymerization method in which toner particles are formed from monomers. Japanese Patent (JP-B) No. 3141783 discloses some advantages of the emulsion-aggregation method in terms of an expansion of selection range of resins, controllability of polarity, and the like. In addition, it is advantageous in capability of controlling a toner structure, i.e. controlling a core-shell structure of toner particles. However, the shell structure comprises a layer containing only resins and aims for reducing the amount of pigments and waxes exposed on surface of toner, and it is disclosed that the toner is not innovative in its surface condition and does not have an innovative structure (The 4th-Joint Symposium—the Imaging Society of Japan and the Japan Society of Static Electricity (held on Jul. 29, 2002)). Thus, a toner produced by the emulsion-aggregation method is formed in a shell-structure, however, the toner surface comprises generally used resins and does not have an innovative structure, and there is a problem that when further lower-temperature fixing is pursued, it is not sufficient in heat resistant storage stability, and environmental charge stability.

In addition, in any of the suspension polymerization method, the emulsion polymerization method, and the emulsion aggregation method, styrene-acrylic resins are typically used, and with the use of polyester resins, it is difficult to granulate toner and difficult to control particle diameter, particle size distribution, and shape of toner. When further lower-temperature fixing is pursued, there are limitations in fixing property.

Further, aiming for excellent heat resistant storage stability and low-temperature fixing, using a polyester modified with urea-bonding has been known (Japanese Patent Application Laid-Open (JP-A) No. 11-133667), however, the surface of the toner is not particularly contrived, and there is a problem in environmental charge stability under strict conditions.

In the field of electrophotography, obtaining high-quality of images has been studied from various angles. Among these studies, it has been increasingly recognized that making toner in smaller diameter and in a spherical form is extremely effective in obtaining high-quality of images. There seems to be tendencies that with increasingly smaller diameter of toner, transferring property and fixing property are lowered, which leads to poor images. It has been known that transferring property is improved by forming a toner in a spherical shape (Japanese Patent Application Laid-Open (JP-A) No. 09-258474).

In these circumstances, in the fields of color copiers and color printers, further higher-speed image forming is required. To respond to higher-speed image forming, an apparatus employing tandem-type technique is effectively used (Japanese Patent Application Laid-Open (JP-A) No. 05-341617). The tandem-type technique is a technique by which images formed by an image forming unit are sequentially superimposed and transferred onto a single transferring paper sheet transported by a transferring belt to thereby obtain a full-color image on the transferring paper sheet. A color image forming apparatus based on the tandem-type technique has excellent characteristics of allowing a variety types of transferring paper sheet for use, having high-quality of full-color image, and enabling full-color images at high speeds. In particular, a capability of obtaining full-color images at high speeds is a characteristic unique to the tandem-type technique. The characteristic is not found in a color image forming apparatus employing other techniques.

On the other hand, there have been attempts to achieve high-quality image as well as speeding-up using a toner formed in a spherical shape. To respond to further higher-speeding up, speedy fixing property is required, however, a spherically-shaped toner satisfying excellent fixing property as well as excellent low-temperature fixing property has not yet been realized so far.

In addition, when a toner is stored and delivered after production of the toner high-temperature and high humidity environment, low-temperature and low humidity environment are harsh conditions for the toner. A toner of which toner particles do not flocculate each other during the time of storage, has no degradation or exhibits less degradation in charge property, flowability, transferring property, and fixing property, and excels in storage stability has been required, however, an effective measure to respond to these requirements, particularly in spherically-shaped toners, has not yet been found so far.

Further, as a method for improving chargeability of a toner, in particular, a negatively charged toner, it is also known that a fluoride compound is contained in a toner to serve as a charge controlling agent, and the like (Japanese Patent (JP-B) Nos. 2942588, 3102797, and other documents). It is known that when these fluoride resins are used, the fixing ability (fixing temperature range) of the toner degrades, although the chargeability thereof are surely improved, and an effective technique to assure low-temperature fixing property and to prevent a small amount of hot offset events has been desired. There has been an attempt to control the atomic mass of fluoride on the toner surface (Japanese Patent (JP-B) No. 3407521), however, the main purpose of the invention is to improve the chargeability of toner, and the invention does not allow for fixing property, and so the fixing property of the toner degrades undesirably.

SUMMARY OF THE INVENTION

It is therefore an object of the present invention to solve the problems state above and to stably provide the following even when several tens of thousands of image sheets are output.

Namely, the object of the present invention is to provide a toner which has sufficiently high chargeability and less toner spent to a carrier or the like even when several tens of thousands of image sheets are output, is capable of keeping high-charge property and flowability without causing substantial background smear or toner fogging, excels in low-temperature fixing property and hot-offset property, and has a wide range of fixing temperature as well as to provide a developer, an image forming apparatus, a process cartridge, and an image forming method using the toner for developing electrostatic images.

To provide a toner which is usable in a low-temperature fixing system while keeping the cleaning ability and is excellent in anti-offset property without causing smear in the fixing apparatus and images, as well as to provide a developer, an image forming apparatus, a process cartridge, and an image forming method using the toner for developing electrostatic images.

To provide a toner which has a sharp charge amount distribution having less weakly charged toner or oppositely-charged toner particles and is capable of forming visible image having excellent sharpness over a long period of time, as well as to provide a developer, an image forming apparatus, a process cartridge and an image forming method using the toner for electrostatic images.

To provide an image forming apparatus, a process cartridge, and an image forming method by which images being excellent in charge stability in high-temperature and high-humidity conditions can be formed without substantially causing background smear and/or toner fogging, and there is less toner scattering in the machine.

And, to provide an image forming apparatus, a process cartridge, and an image forming method each of which is provided with high-durability and low-maintenance property.

As a result of keen examinations provided by the inventors of the present invention to achieve the objects, it is found that in a toner containing a colorant and a resin, by use of a toner for developing electrostatic images which is characterized in that the atomic number ratio (F/C) of fluoride atoms to carbon atoms on the surfaces of the toner particles is 0.010 to 0.054, it is possible to provide a toner which has sufficiently high chargeability and less toner spent to a carrier or the like even when several tens of thousands of image sheets are output, is capable of keeping high-charge property and flowability without causing substantial background smear or toner fogging, excels in low-temperature fixing property and hot-offset property, and has a wide range of fixing temperature as well as to provide a developer, an image forming apparatus, a process cartridge, and an image forming method using the toner for developing electrostatic images.

The mechanism is being elucidated, however, the following is presumed from a number of analyzed data.

The present invention is effective particularly to a negatively charged toner formed by dispersing oil droplets of an organic solvent with a toner composition containing a prepolymer dissolved therein in an aqueous medium and subjecting the dispersion to an elongation reaction and/or a cross-linking reaction. The toner is insufficient in charge stability, and thus it is possible to make the toner have further highly negative charge property by using a fluoride compound containing fluoride atoms having high electronegativity. On the other hand, to ensure low-temperature fixing property of the toner, it is important to ensure affinity of the toner for paper, however, when a large amount of hydrophobic fluoride atoms is contained in a toner, the affinity of the toner for paper having a large amount of hydroxyl groups degrades. Therefore, it is preferable that the atomic mass of fluoride is small. Further, when considering hot-offset property of the toner, it is found that the hot-offset margin is narrowed because of the low-affinity of the toner for paper, and the toner easily adheres on fixing member such as fixing belts and fixing rollers, and thus it is desirable that the atomic mass of fluoride is as least as possible. However, it is desirable to use an appropriate amount of fluoride to balance with the charge retention capability.

In the present invention, it is found that a balance between the charge property and the fixing property can be achieved by controlling the value of atomic number ratio (F/C) of fluoride atoms and carbon atoms residing on the toner surface which are particularly contributing to charging to 0.010 to 0.054.

It is more desirable that the effect of fluoride is more exerted by using a method for producing a toner for developing electrostatic images which includes dispersing the fluoride compound in water containing alcohol, and then making the dispersion adhere on the toner surface or bounded to the toner particles.

In addition, being a toner for developing electrostatic images which is characterized in that the resin used in the toner contains a polyester resin is more preferable, because the affinity of the toner for the fluoride compound is more improved, and the effect of fluoride can be more effectively exerted.

Further, being a toner for developing electrostatic images which is characterized in that the toner binder contains a modified polyester (i) along with an unmodified polyester (ii), and the weight ratio of the modified polyester (i) to the unmodified polyester (ii) is 5/95 to 80/20 is more preferable because it is possible to improve the affinity of the toner for the fluoride compound, and the effect of fluoride can be more effectively exerted.

Further, being a toner for developing electrostatic images which is characterized in that the fluoride compound is represented by General Formula 1 is more preferable in terms of charge imparting capability, and charge sustaining capability.

General Formula 1

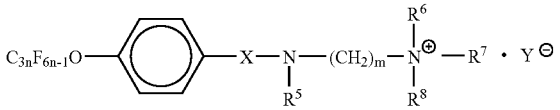

(In General Formula 1, X represents —$SO^2$— or —CO—; $R^5$, $R^6$, $R^7$, and $R^8$ is a group individually selected from the group consisting of hydrogen atoms, alkyl groups having carbon atoms of 1 to 10 and aryl groups; "m" and "n" is an integer; and Y is a halogen atom such as I, Br, and Cl.)

To make a toner for developing electrostatic images have a substantially spherical shape of the average circularity E of the toner particles being 0.90 to 0.99 is more preferable because concave convex on the toner surface can be controlled, dispersion of the fluoride compound to the toner surface is easily controlled, and transferring property and high-quality images without dust can be obtained.

In addition, to make a toner for developing electrostatic images which is characterized in that the circularity SF-1 value of the toner is 100 to 140, and the circularity SF-2 value of the toner is 100 to 130, it is more preferable because concave and convex of the toner surface can be controlled with the SF2 value, the spherical shape (including sphere, ellipsoid, and the like) of the entire toner particles can be controlled with the SF2 value, and the fluoride compound to the toner surface is easily controlled. Further, transferring property of the toner and high-quality images without dust can be obtained.

In addition, being a toner for developing electrostatic images which is characterized in that the volume average particle diameter Dv of the toner particles is 2 μm to 7 μm, and the ratio Dv/Dn of the volume average particle diameter Dv and the number average particle diameter Dn is 1.15 or less is preferable in that adhesion of the fluoride compound to the toner surface is effectively workable, and the effect of fluoride can be more exerted.

Further, being a two-component developer which is characterized in that the two-component developer contains a carrier including the toner and magnetic particles is more preferable in that inadequacy of charge stability of a nitrogen-containing polyester can be compensated, and a sufficiently sharp charge amount distribution can be imparted.

According to the present invention, the following aspects (1) to (16) can be provided:

(1) A toner for developing electrostatic images containing a colorant, a resin, and a fluoride compound, wherein the fluoride compound exists on the surfaces of toner particles, and the atomic number ratio (F/C) of fluoride atoms to carbon atoms existing on the surfaces of the toner particles is 0.010 to 0.054.

(2) The toner for developing electrostatic images according to the item (1), wherein the toner is formed by dispersing oil droplets of an organic solvent with a toner composition containing a prepolymer dissolved therein in an aqueous medium, and subjecting the dispersion to an elongation reaction and/or a cross-linking reaction.

(3) The toner for developing electrostatic images according to the item (1), wherein the toner contains a polyester resin.

(4) The toner for developing electrostatic images according to the item (1), wherein the toner contains a modified polyester resin.

(5) The toner for developing electrostatic images according to the item (1), wherein the toner contains an unmodified polyester (ii) along with the modified polyester (i), and the weight ratio of the modified polyester (i) to the unmodified polyester (ii) is 5/95 to 80/20.

(6) The toner for developing electrostatic images according to the item (1), wherein the fluoride compound is a compound represented by General Formula 1:

General Formula 1

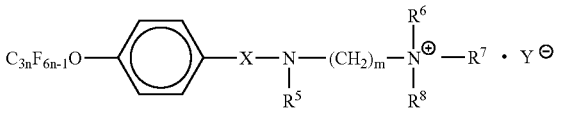

where X represents —SO²— or —CO—; $R^5$, $R^6$, $R^7$, and $R^8$ is a group individually selected from the group consisting of hydrogen atoms, alkyl groups having carbon atoms of 1 to 10, and aryl groups; "m" and "n" is an integer; and Y is a halogen atom such as I, Br and Cl.

(7) The toner for developing electrostatic images according to the item (1), wherein the toner particles are formed in a substantially spherical shape with an average circularity E of 0.90 to 0.99.

(8) The toner for developing electrostatic images according to the item (1), wherein the circularity SF-1 value of the toner particles is 100 to 140, and the circularity SF-2 value of the toner particles is 100 to 130.

(9) The toner for developing electrostatic images according to the item (1), wherein the volume average particle diameter Dv of the toner particles is 2 μm to 7 μm, and the Dv/Dn ratio of the volume average particle diameter Dv to the number average particle diameter Dn is 1.15 or less.

(10) The toner for developing electrostatic images according to the item (1), wherein the fluoride compound is contained in a content of 0.01% by weight to 5% by weight relative to the total weight of the toner.

(11) A method for producing a toner for developing electrostatic images including dispersing a fluoride compound in alcohol containing water, and making the fluoride compound adhere on or bound to the surface of the toner, wherein the toner contains a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054.

(12) A two-component developer containing a toner for developing electrostatic images, and a carrier which contains magnetic particles, wherein the toner for developing electrostatic images contains a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054.

(13) An image forming apparatus including a photoconductor, a charging unit configured to charge the photoconductor, an exposing unit configured to expose the photoconductor charged by use of the charging unit with a write laser beam to form a latent electrostatic image, a developing unit with a developer loaded therein configured to develop the latent electrostatic image into a visible image by supplying the developer to the photoconductor to thereby form a toner image, and a transferring unit configured to transfer the toner image formed by use of the developing unit onto a transferring member, wherein the developer is a two-component developer which contains a toner for developing electrostatic images and a carrier; the toner for developing electrostatic images contains a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054; and the carrier comprises magnetic particles.

(14) An image forming method including charging a photoconductor, exposing the photoconductor charged in the charging unit with a write laser beam to form a latent electrostatic image, developing the latent electrostatic image into a visible image by supplying the developer to the photoconductor to thereby form a toner image, and transferring the toner image formed in the developing onto a transferring member, wherein the developer is a two-component developer which contains a toner for developing electrostatic images and a carrier; the toner for developing electrostatic images contains a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054; and the carrier comprises magnetic particles.

(15) The image forming method according to the item (14), wherein the transferring includes transferring the toner image formed on the photoconductor onto an intermediate transfer member, and transferring the toner image on the intermediate transfer member onto a final transfer member.

(16) A process cartridge including a photoconductor, and one or more units selected from a charging unit configured to charge the photoconductor, a developing unit with a developer loaded therein configured to develop a latent electrostatic image formed by means of exposure into a visible image by supplying the developer to the photoconductor to thereby form a toner image, and a cleaning unit configured to remove a residual toner remaining on the photoconductor after transferring, the one or more units are integrally supported so as to be detachably mounted on the main body of an image forming apparatus, wherein the developer is a two-component developer which contains a toner for developing electrostatic images and a carrier; the toner for developing electrostatic images contains a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054; and the carrier comprises magnetic particles.

According to the present invention, the following effects can be exerted:

1) it is possible to provide a toner which has sufficiently high chargeability and less toner spent to a carrier or the like even when several tens of thousands of image sheets are output, is capable of keeping high-charge property and flowability without causing substantial background smear or toner fogging, excels in low-temperature fixing property and hot-offset property, and has a wide range of fixing temperature as well as to provide a developer, an image forming apparatus, a process cartridge, and an image forming method using the toner for developing electrostatic images.

2) it is possible to provide a toner which is usable in a low-temperature fixing system while keeping the cleaning ability and is excellent in anti-offset property without causing smear in the fixing apparatus and images, as well as to provide a developer, an image forming apparatus, a process cartridge, and an image forming method using the toner for developing electrostatic images.

DESCRIPTION OF THE PREFERRED EMBODIMENTS

Figure 1:
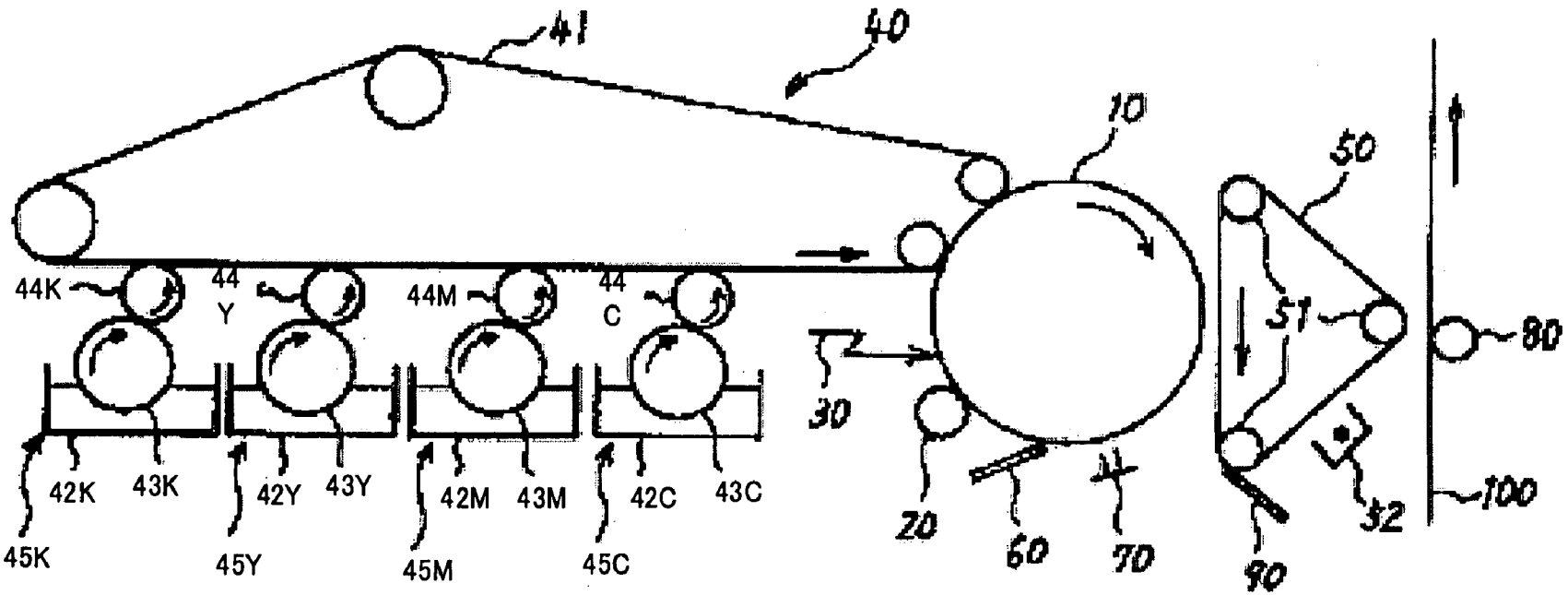
FIG. 1 is a schematic block diagram showing an example of the copier according to an embodiment of the present invention.

Hereinafter, the present invention will be further described in detail. As for a method for producing a toner and/or a developer, materials, and overall systems relating to electrophotographic process used in the present invention, all those known in the art can be used, provided that requirements are met.

(Fluoride Compound)

The fluoride compound used for the toner of the present invention is not particularly limited and any organic compounds and inorganic compounds can be used, provided that the fluoride compound is a compound containing fluoride atoms. Of these compounds, compounds represented by General Formula 1 are more preferably used.

General Formula 1

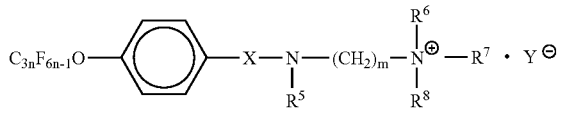

(In General Formula 1, X represents —$SO^2$— or —CO—; $R^5$, $R^6$, $R^7$, and $R^8$ is a group individually selected from the group consisting of hydrogen atoms, alkyl groups having carbon atoms of 1 to 10 and aryl groups; "m" and "n" is an integer; and Y is a halogen atom such as I, Br, and Cl.)

As for the charge controlling agent, it is preferable to use a fluoride containing quaternary ammonium salt in combination with a metal containing azo dye.

Specific typical examples of the compounds represented by General Formula 1 include the following fluoride compounds (1) to (27), and those compounds are white or light yellow in color. In addition, Y is more preferably iodine.

(1)

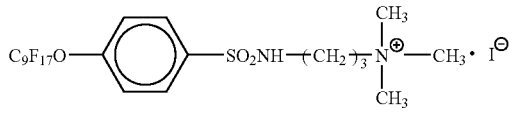

(2)

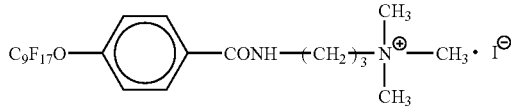

(3)

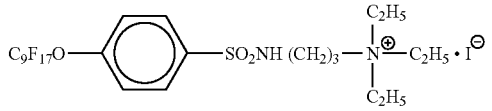

(4)

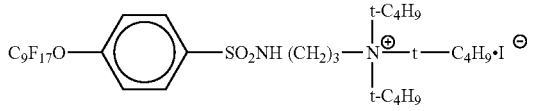

(5)

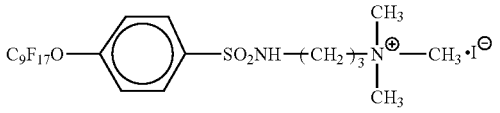

-continued
(6)
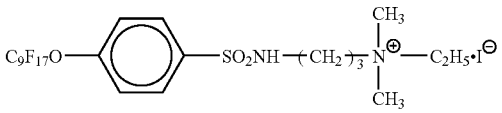
(7)
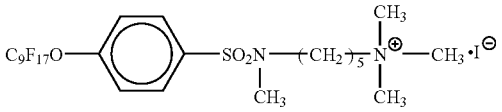
(8)
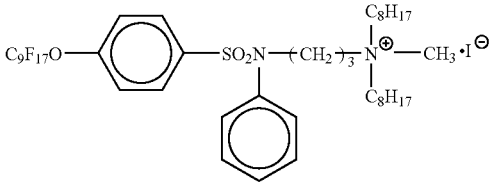
(9)
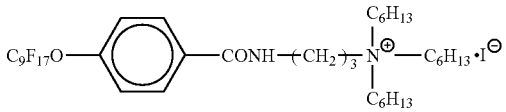
(10)
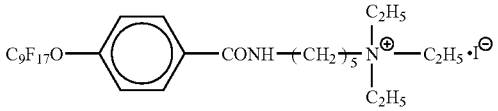
(11)
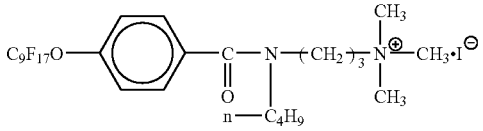
(12)
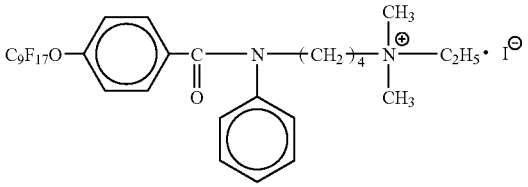
(13)
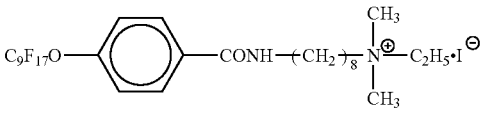
(14)
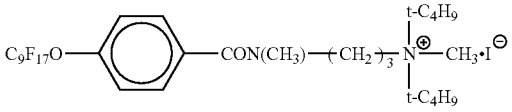
(15)
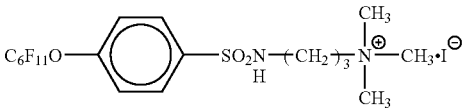
(16)
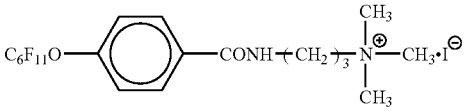
-continued
(17)
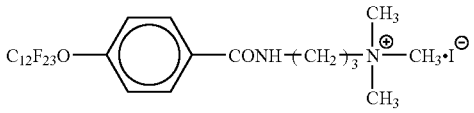
(18)
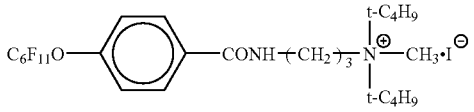
(19)
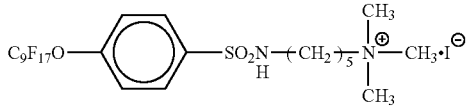
(20)
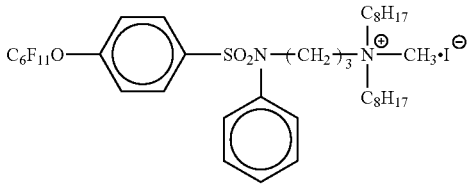
(21)
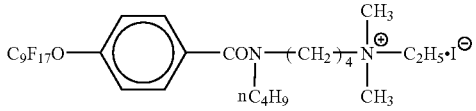
(22)
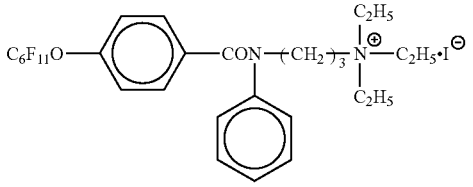
(23)
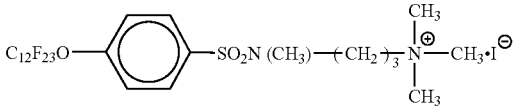
(24)
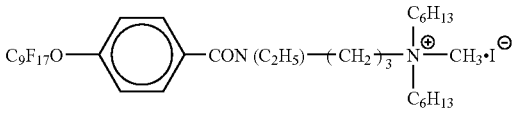
(25)
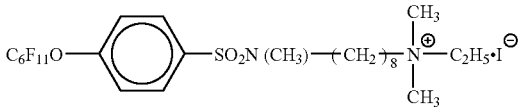
(26)
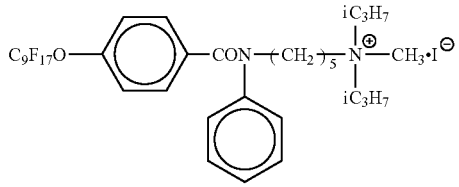

-continued (27)

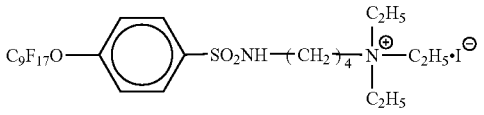

Among these compounds, N,N,N-trimethyl-[3-(4-perfluorononenyloxybenzamide)propyl] ammonium iodide is particularly preferable in terms of charge imparting capability. In addition, mixtures of the compounds and other fluoride compounds are more preferable. The effects of the present invention are not limited to properties of the fine powder such as the purity, PH, thermal decomposition temperature of the fluoride compound.

The fluoride compound can be used for subjecting a toner to a surface treatment preferably in a range of 0.01% by weight to 5% by weight and more preferably in a range of 0.01% by weight to 3% by weight relative to the entire weight of the toner. When the amount of the fluoride compound used for the surface treatment is less than 0.01% by weight, the effects of the present invention may not be sufficiently obtained. When the amount of the fluoride compound used for the surface treatment is more than 5% by weight, it is unfavorable because a fixing-failure of the developer occurs.

As a method for subjecting the toner to a surface treatment using the fluoride compound, toner base particles before addition of inorganic fine particles are dispersed in an aqueous solvent in which the fluoride compound has been dispersed (water containing a surfactant is also preferable) to make the fluoride compound adhere on the toner surface or make the fluoride compound ion-bound to the toner surface, then solvent is removed, and the toner surface is dried to thereby obtain toner base particles, however, the method is not limited to the method stated above. In the dispersion process, alcohol is mixed in the aqueous solvent containing the fluoride compound in a content of 5% by weight to 80% by weight, more preferably in a content of 10% by weight to 50% by weight, it is more preferable because the dispersibility of the fluoride compound can be more improved, the adhesion of the fluoride compound to the toner surface is uniformly performed, and the charge uniformity among toner particles can be improved.

At the same time, known methods in the art for making the fluoride compound adhere on the toner surface or the fluoride compound fixed to the toner surface may also be used. For example, the following methods may be used: adhesion and fixing of the fluoride compound to the toner surface utilizing a mechanical shearing force; fixing of the fluoride compound to the toner surface by means of a combination of mixing and heating; or fixing the fluoride compound to the toner surface by means of a combination of mixing and mechanical shock; or fixing the fluoride compound to the toner surface by means of chemical methods such as covalent bonding between the toner and the fine powder; hydrogen bonding between the toner and the fine powder; and ion-bonding between the toner and the fine powder.

(Amount of Fluoride on Toner Surface)

The atomic number ratio (F/C) of fluoride atoms and carbon atoms on surface of toner particles in the present invention can be determined using an XPS (X-ray photoelectron spectrometer). In the present invention, the atomic number ratio F/C was determined using the following apparatus and conditions:

(1) Pretreatment

The toner was put on an aluminum tray, and the toner was lightly pressed to measure the weight.

(2) Apparatus

X-ray photoelectron spectrometer 1600S manufactured by Philips Electronics N.V.

(3) Measurement Conditions

X-ray source MgKα (100 W)

Analyzed area 0.8 mm×2.0 mm (External Additive)

As for external additives supplementing flowability, developing property, and charge property of colored particles obtained in the present invention, it is preferable to use inorganic fine particles in combination with organic fine particles. As the external additives, it is possible to use both inorganic fine particles hydrophobized inorganic fine, however, it is more preferable that the external additives contains one or more types of inorganic fine particles having an average particle diameter of hydrophobized primary particles being 1 nm to 100 nm, and more preferably 5 nm to 70 nm. It is further desirable that the external additive contains one or more types of inorganic fine particles having an average particle diameter of hydrophobized primary particles being 20 nm or less, and more preferably the external additive further contains one or more types of inorganic fine particles having an average particle diameter of hydrophobized primary particles being 30 nm or more. In addition, the specific surface area of the inorganic fine particles determine dby BET method is preferably 20 $m^2/g$ to 500 $m^2/g$.

For these inorganic fine particles, all those known in the art can be used, provided that the requirements are met. These inorganic fine particles may include the inorganic fine particles include silica fine particles, hydrophobized silicas, metallic salts of fatty acids (zinc stearate, aluminum stearate, and the like); metal oxides (titania, alumina, tin oxides, antimony oxides, and the like); and fluoro-polymers.

Particularly preferred examples of the external additives include hydrophobized silica fine particles, titania fine particles, titanium oxide fine particles, and alumina fine particles. Examples of the silica fine particles include HDK H 2000, HDK H 2000/4, HDK H 2050EP, HVK21, and HDK H 1303 (manufactured by Hochst Corporation); and R972, R974, RX200, RY200, R202, R805, and R812 (manufactured by Nippon AEROSIL CO., LTD.). Examples of the titania fine particles include P-25 (manufactured by Nippon AEROSIL CO., LTD.); STT-30, and STT-65C-S (manufactured by Titanium Kogyo K.K); TAF-140 (manufactured by FUJI TITANIUM INDUSTRY CO., LTD.); and MT-150W, MT-500B, MT-600B, and MT-150A (manufactured by TAYCA CORPORATION). Examples of the hydrophobized titanium oxide fine particles include T-805 (manufactured by Nippon AEROSIL CO., LTD.); STT-30A, STT-65S-S (manufactured by Titanium Kogyo K.K.); TAF-500T, and TAF-1500T (manufactured by FUJI TITANIUM INDUSTRY CO., LTD.); MT-100S and MT-100T (manufactured by TAYCA CORPORATION); and IT-S (manufactured by ISHIHARA INDUSTRY CO., LTD.).

To obtain hydrophobized oxide fine particles, hydrophobized silica fine particles, hydrophobized titania fine particles, and hydrophobized alumina fine particles, hydrophilic fine particles are subjected to a coupling with a silane coupling agent such as methyltrimethoxy silane, methyltriethoxy silane, and octyl trimethoxy silane. When necessary, silicone oil-treated oxide fine particles and inorganic fine particles of which inorganic fine particles are subjected to a surface treatment with a heated silicone oil are favorably used.

As for the silicone oil, it is possible to use dimethyl silicone oils, methylphenyl silicone oils, chlorphenyl silicone oils, methylhydrogen silicone oils, alkyl-modified silicone oils, fluoride-modified silicone oils, polyether-modified silicone oils, alcohol-modified silicone oils, amino-modified silicone oils, epoxy-modified silicone oils, epoxypolyether-modified silicone oils, phenol-modified silicone oils, carboxyl-modified silicone oils, mercapto-modified silicone oils, acryl-modified silicone oils, methacryl-modifiend silicone oils, and α methylstyrene-modified silicone oils, and the like.

Examples of the inorganic fine particles include silicas, aluminas, titanium oxides, barium titanates, magnesium titanates, calcium titanates, strontium titanates, zinc oxides, tin oxides, silica sand, clay, mica, wallastonite, silious earth, chrome oxides, cerium oxides, colcothar, antimony trioxides, magnesium oxides, zirconium oxides, barium sulfides, barium carbonates, calcium carbonates, silicon carbides, and silicon nitrides. Among these organic fine particles, silicas and titanium dioxides are particularly preferable. The added amount of the inorganic fine particles to the toner is preferably 0.1% by weight to 5% by weight, and more preferably 0.3% by weight to 3% by weight. The average particle diameter of primary particles of the inorganic fine particles is typically 100 nm or less, and preferably 3 nm to 70 nm. When the average primary particle diameter is less than 3 nm, the inorganic fine particles are embedded to the toner, and the function of the inorganic fine particles is hardly effectively exerted. When the average primary particle diameter is more than 100 nm, it is unfavorable because the inorganic fine particles non-uniformly impair the surface of a photoconductor.

The primary particle diameter of the inorganic fine particles is preferably 5 nm to 2 μm, and inorganic fine particles having a primary particle diameter of 5 nm to 500 nm are particularly preferable. The specific surface area according to the BET method is preferably 20 $m^2/g$ to 500 $m^2/g$. The amount of the inorganic fine particles used in the toner is preferably 0.01% by weight to 5% by weight, and more preferably 0.01% by weight to 2.0% by weight. Specific examples of the inorganic fine particles include silicas, aluminas, titanium oxides, barium titanates, magnesium titanates, calcium titanates, strontium titanates, zinc oxides, tin oxides, silica sand, clay, mica, wallastonite, silious earth, chrome oxides, cerium oxides, colcothar, antimony trioxides, magnesium oxides, zirconium oxides, barium sulfates, barium carbonates, calcium carbonates, silicon carbides, and silicon nitrides.

Examples of external additives other than the above-mentioned include polymeric fine particles, for example, polystyrenes, and methacrylic acid esters obtained by soap-free emulsion polymerization, suspension polymerization, and dispersion polymerization; acrylic acid ester copolymers; and polymer particles based on polycondensation resins and thermosetting resins such as silicones, benzoguanamines, and nylons.

By subjecting the fluidizers stated above to a surface treatment to enhance hydrophobic property thereof, it is possible to prevent degradation of flowability and charge property of the toner even under high-humidity conditions. Preferred examples of surface treatment agents include silane coupling agents, silyl agents, silane coupling agents having a fluoro-alkyl group, organic titanate coupling agents, aluminum coupling agents, silicone oils, and modified silicone oils.

Examples of a cleaning ability improver used to remove a residual developer remaining on a photoconductor and a primary transferring medium after image transfer include metallic salts of fatty acids such as zinc stearates, calcium stearates, and stearic acids; and polymer fine particles produced by means of soap-free emulsion polymerization such as polymethyl methacrylate fine particles, and polystyrene fine particles. Polymer fine particles having a relatively narrow particle size diameter and an average volume particle diameter of 0.01 μm to 1 μm are preferably used.

(Average Circularity E)

It is important that the toner of the present invention has a specific shape and a specific shape distribution. With a toner having an average circularity less than 0.90 and formed in an indefinite shape which is far from a spherical shape, it is impossible to obtain satisfactory transferring property and high-quality images without dust. With a toner having an average circularity more than 0.99, the toner is formed in a perfect sphere, and it is unfavorable because there may be problems with cleaning ability. For the method of measuring shape of toner, an optical detection zone technique is properly used in which a suspension containing toner particles is passed through an imaging part detection zone disposed on a plate to optically, detect the particle image of the toner by means of a CCD camera and analyze the shape of the toner. The value obtained by dividing the circumferential length of a circle being equivalent to the projection area determined by the method by the circumferential length of an actual particle is the average circularity E. In order to form high-resolution images having an appropriate density and reproductivity using a toner, it is more preferable that the average circularity E of the toner is 0.94 to 0.99. Focusing on the ease of cleaning ability, it is more suitable that toner particles having an average circularity E being 0.94 to 0.99 and a circularity of 0.94 or less are contained at 10% or less.

The average circularity E can be measured using a flow particle image analyzer (FPIA-1000; manufactured by SYSMEX Corp.). The specific method for measuring the average circularity E is as follows. To a vessel, 100 mL to 150 mL of water that impure solids therein have been removed, 0.1 mL to 0.5 mL of a surfactant, preferably alkylbenzene sulfonate is added as a dispersing agent, and 0.1 g to 0.5 g of a measurement sample is further added. The suspension with the sample dispersed therein is subjected to a dispersion treatment in an ultrasonic dispersing unit for around 1 minute to 3 minutes, and the concentration of the dispersion is set to 3,000 pieces to 10,000 pieces/μL to measure the shape and distribution of the toner using the flow particle image analyzer. The average circularity E is determined from the measured values.

(Circularity SF-1 and SF-2)

For shape factors SF-1 and SF-2 each of which indicates a circularity used in the present invention, 300 sheets of images measured and obtained by using a scanning electron microscope FE-SEM (S-4200) manufactured by Hitachi, Ltd. were taken at random as samples. The image information was introduced to an image analyzer (Luzex AP, manufactured by NIRECO Corporation) through an interface and analyzed. The values calculated from the following equations were defined as SF-1, and SF-2. As the values of SF-1, and SF-2, the values measured by use of Luzex are preferable, however, a scanning electron microscope and an image analyzer used in the present invention are not particularly limited to the above-noted FE-SEM and the image analyzer, provided that similar analyzed results are obtainable.

$$SF\text{-}1=(L^2/A)\times(\pi/4)\times100$$

$$SF\text{-}2=(L^2/A)\times(1/4\pi)\times100$$

In the above equations, the absolute maximum length of the toner is defined as L the projection area of the toner is defined as A, and the maximum circumferential length of the toner is defined as P. When the toner is formed in a perfect sphere, the values of SF-1 and SF-2 are respectively 100. The greater than 100 the value is, the closer to a indefinite shape from a sphere shape of the toner. In particular, SF-1 represents a shape of whole of the toner (sphere, ellipsoid, and the like), and SF-2 is a shape factor representing a degree of concave convex on the toner surface.

(Volume Average Particle Diameter, and Ratio of Dv/Dn (Volume Average Particle Diameter/Number Average Particle Diameter))

The toner of the present invention preferably has a volume average particle diameter (Dv) of 2 μm to 7 μm. With a dry-process toner having a ratio Dv/Dn of the volume average particle diameter (Dv) to the number average particle diameter (Dn) of 1.25 or less, more preferably 1.10 to 1.25, the toner excels in any of heat resistance storage stability, low-temperature fixing property, and anti-hot-offset property. Particularly when such a toner is used in a full-color copier, it excels in glossiness. In particular, when such a toner is used in a full-color copier, it is excellent in glossiness of image, and when used in two-component developer, there is little variation in the toner particle diameter in the developer even when toner inflow/outflow is performed over a long period of time, and even with long-term agitation of the developer in the image developing unit, excellent and stable developing property can be obtained. In addition, when such a toner was used as a one-component developer, there was little valuation in the particle diameter of the toner, and toner filming to a developing roller and toner fusion to members such as a blade for making toner have a thin layer rarely occurred even when toner inflow/outflow was performed, and it was possible to obtain excellent and stable developing property and images even under long-term use (agitation) of the image developing unit.

Typically, it is said that the smaller in particle diameter of toner, the more advantageous for obtaining high-quality of image with high-resolution, however, on the contrary, it is disadvantageous to transferring property and cleaning ability. When a toner has a volume average particle diameter smaller than the lower limit volume average particle diameter of the present invention and used in a two-component developer, the toner fuses on the surface of carrier over a long-period of agitation in an image developing unit, resulting in reduced chargeability of carrier, and when used as a one-component developer, toner filming to a developing roller and toner fusion to members such as a blade for making toner have a thin layer are liable to occur. These phenomena also occur with a toner which has a content of fine-particles greater than the range defined in the present invention.

On the other hand, with a toner having a particle diameter greater than the upper limit particle diameter of the present invention, it is difficult to obtain high-quality of image with high-resolution, and it is often the case that the particle diameter of the toner may substantially vary when the toner inflow/outflow occurs in the developer. In addition, it was clarified that these phenomena also occur with a toner having a ratio of the volume average particle diameter/the number average particle diameter being 1.25 or more.

(Modified Polyester Resin)

In the present invention, the modified polyester resins stated below can be used as a polyester resin. For example, a polyester prepolymer having an isocyanate group can be used. Examples of the polyester prepolymer having an isocyanate group (A) include a polyester resin being a polycondensate between polyol (1) and polycarboxylic acid (2) and further being a reactant obtained by reacting polyester having an active hydrogen group with polyisocyanate (3). Examples of the active hydrogen group held by the polyester include hydroxyl group (alcoholic hydroxyl group and phenolic hydroxyl group), amino group, carboxyl group, and mercapto group. Of these, alcoholic hydroxyl group is preferable.

Examples of the polyol (1) include diol (1-1), and trivalent or more polyols (1-2), and diol (1-1) used alone, or a mixture of diol (1-1) with a small amount of trivalent or more polyols (1-2) are preferably used. Examples of the diol (1-1) include alkylene glycols such as ethylene glycol, 1,2-propylene glycol, 1,3-propylene glycol, 1,4-butandiol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenols such as bisphenol A, bisphenol F, and bisphenol S; alkylene oxide adducts of the alicyclic diols such as ethylene oxides, propylene oxides, butylene oxides; and alkylene oxide adduct of the bisphenols such as ethylene oxides, propylene oxides, and butylene oxides. Among the above mentioned, alkylene glycols having 2 to 12 carbon atoms and alkylene oxide adducts of bisphenols are preferable, and alkylene oxide adducts of bisphenols and mixtures of the alkylene oxide adducts of bisphenols with alkylene glycols having 2 to 12 carbon atoms are particularly preferable. Examples of the trivalent or more polyols (TO) include trivalent to octavalent or more polyaliphatic alcohols such as glycerine, trimethylol ethane, trimethylol propane, pentaerythritol, and sorbitol; trivalent or more polyphenols such as trisphenol PA, phenol novolac, and cresol novolac; and alkylene oxide adducts of the trivalent or more polyphenols.

Examples of the polycarboxylic acid (2) include dicarboxylic acids (2-1), and trivalent or more polycarboxylic acids (2-2), and dicarboxylic acid (2-1) alone or mixtures of dicarboxylic acid (2-1) and a small amount of the trivalent or more polycarboxylic acid (2-2) are preferably used. Examples of the dicarboxylic acids (2-1) include alkylene dicarboxylic acids such as succinic acids, adipic acids, and sebacic acids; alkenylen dicarboxylic acids such as maleic acids, and fumaric acids; and aromatic dicarboxylic acids such as phthalic acids, isophthalic acids, terephthalic acids, and naphthalene dicarboxylic acids. Among them, alkenylen dicarboxylic acids having 4 to 20 carbon atoms and aromatic dicarboxylic acids having 8 to 20 carbon atoms are preferable. Examples of the trivalent or more polycarboxylic acids (2-2) are aromatic polycarboxylic acids having 9 to 20 carbon atoms such as trimellitic acids, and pyromellitic acids. For the polycarboxylic acids (2), acid anhydrides selected from those above mentioned or lower alkyl esters such as methyl esters, ethyl esters, and isopropyl esters may be used to react with the polyol (1).

The mixture ratio between the polyols (1) and the polycarboxylic acids (2) represented as the equivalent ratio [OH]/[COOH] of hydroxy group [OH] content in the polyols (1) to carboxyl group [COOH] content in the polycarboxylic acids (2) is typically 2/1 to 1/1, preferably 1.5/1 to 1/1, and more preferably 1.3/1 to 1.02/1. Examples of the polyisocyanate (3) include aliphatic polyisocyanates such as tetramethylen diisocyanate, hexamethylene diisocyanate, and 2,6-diisocyanato methyl caproate; alicyclic polyisocyanates such as isophorone diisocyanate, and cyclohexyl methane diisocyanate; aromatic diisocyanates such as tolylene diisocyanate, and diphenylmethane diisocyanate; aromatic aliphatic diisocyanates such as α,α,α',α'-tetramethyl xylylene diisocyanate; isocyanurates; polyisocyanates of which the above-noted isocyanates are blocked with phenol derivatives, oximes, and caprolactams; and polyisocyanates of which each of the above-noted used in combination with two or more.

For the mixture ratio of the polyisocyanate (3), for example, the equivalent ratio [NCO]/[OH] of isocyanate group [NCO] content in the polyisocyanate (3) to hydroxy group [OH] content in the hydroxy-containing polyester is typically 5/1 to 1/1, preferably 4/1 to 1.2/1, and more preferably 2.5/1 to 1.5/1. When the ratio [NCO]/[OH] is more than 5, low-temperature fixing property degrades, and when the molar ratio of [NCO] is less than 1, anti-offset property degrades due to reduced urea content in the modified polyester. The content of polyisocyanate (3) component in the isocyanate-terminated prepolymer (A) is typically 0.5% by weight to 40% by weight, preferably 1% by weight to 30% by weight, and more preferably 2% by weight to 20% by weight. When the content is less than 0.5% by weight, anti-hot-offset property degrades, and it is disadvantageous in obtaining satisfactory heat resistant storage stability and low-temperature fixing property. When the content is more than 40% by weight, low-temperature fixing property tends to degrade.

The number of isocyanate groups contained in per molecule in the isocyanate-group containing polyester prepolymer (A) is typically one or more, preferably 1.5 to 3 on average, and more preferably 1.8 to 2.5 on average. When the number of isocyanate groups per molecule is less than 1, the molecular weight of urea-modified polyester decreases, resulting in degraded anti-hot-offset property.

(Crosslinking Agent and Elongating Agent)

In the present invention, amines may be used as crosslinking agents and/or elongating agents. Examples the amines (B) include diamines (B1), trivalent or more polyamines (B2), aminoalcohols (B3), aminomercaptans (B4), amino acids (B5), and compounds (B6) in which any of the amino groups B1 to B5 is blocked. Examples of the diamine (B1) include aromatic diamines such as phenylene diamine, diethyl toluene diamine, and 4,4'-diamino diphenyl methane; alicyclic diamines such as 4,4'-diamino-3,3'-dimethyl dicyclohexyl methane, diamine cyclohexane, and isophorone diamine, and aliphatic diamines such as ethylene diamine, tetramethylene diamine, and hexamethylene diamine. Examples of the trivalent or more polyamines (B2) include diethylene triamine, and triethylene tetramine. Examples of the aminoalcohols (B3) include ethanol amine, and hydroxyethylaniline. Examples of the amino mercaptans (B4) include aminoethyl mercaptan, and aminopropyl mercaptan. Examples of the amino acids (B5) include aminopropionic acids, aminocaproic acids. Examples of the amino acids (B5) include aminopropyonic acids, and amonocaproic acids. Examples of the compounds (B6) in which the amino groups B1 to B5 are blocked include ketimine compounds which are obtained from any of the above-noted amines B1 to B5 and ketones such as acetones, methyl ethyl ketones, and methyl isobutyl ketones, and oxazolidone compounds. Of these amines (B), (B1) alone and mixtures of (B1) and a small amount of (B2) are preferable.

Further, in accordance with the necessity, the molecular weight of the modified polyester can be adjusted by using an elongation stopper. Examples of the elongation stopper include monoamines such as diethylamines, dibutylamines, butylamines, and lauryl amines or compounds in which any of these monoamines are blocked (ketimine compounds).

For the mixture ratio of the amines (B) to the isocyanate-group containing polyester prepolymer (A), the equivalent ratio [NCO]/[NHx] of the isocyanate group [NCO] in the isocyanate-group containing polyester prepolymer (A) to the amino group [NHx] in the amines (B) is typically 1/2 to 2/1, preferably 1.5/1 to 1/1.5, and more preferably 1.2/1 to 1/1.2. When the equivalent ratio [NCO]/[NHx] is more than 2 or less than 1/2, the molecular weight of the urea-modified polyester (i) is reduced, resulting in degraded anti-hot-offset property.

(Unmodified Polyester)

In the present invention, it is important to use not only the modified polyester (A) alone but also to use an unmodified polyester (C) as a toner binder component together with the modified polyester (A). By using an unmodified polyester (C) in combination with a modified polyester (A), low-temperature fixing property and glossiness of the toner when used in a full-color unit are improved. Examples of the unmodified polyester (C) include polycondensation products between polyols (1) and polycarboxylic acids (2), which are same as those of polyester components of the modified polyester (A), and preferred unmodified polyesters are also same as those of the modified polyester (A). The unmodified polyester (C) may include not only unmodified polyesters but also polyesters modified by chemical binding other than urea-binding, for example, it may be polyesters modified by urethane-binding. It is preferred that the modified polyester (A) be partially compatible with the unmodified polyester (C) from the perspective of low-temperature fixing property and anti-hot-offset property. Thus, it is preferred that the composition of the modified polyester (A) components be similar to that of the unmodified polyester (C) components. The weight ratio of the modified polyester (A) and the unmodified polyester (C) when the modified polyester (A) is used in combination with the unmodified polyester (C) is typically 5/95 to 75/25, preferably 10/90 to 25/75, more preferably 12/88 to 25/75, and particularly preferably 12/88 to 22/78. When the weight ratio of the modified polyester (A) is less than 5%, anti-hot-offset property may degrade, and it may be disadvantageous in obtaining satisfactory heat resistance storage stability and low-temperature fixing property.

The peak molecular weight of the unmodified polyester (C) is typically 1,000 to 30,000, preferably 1,500 to 10,000, and more preferably 2,000 to 8,000. When the peak molecular weight is less than 1,000, heat resistance storage stability degrades, and when the peak molecular weight is more than 10,000, low-temperature fixing property degrades. The hydroxy group value of the unmodified polyester (C) is preferably 5 or more, more preferably 10 to 120, and still more preferably 20 to 80. When the hydroxy group value of the unmodified polyester (C) is less than 5, it is disadvantageous in obtaining satisfactory heat resistance storage stability and low-temperature fixing property. The acid value of the unmodified polyester (C) is typically 0.5 to 40, and preferably 5 to 35. By making the unmodified polyester (C) have an acid value, the toner tends to have negative electric charge. A toner which contains an unmodified polyester (C) having an acid value more than 40 and a hydroxyl value more than 120 respectively is liable to be affected by the environments under high-temperature and high-humidity conditions and low-temperature and low-humidity conditions and easily causes degradation of images.

In the present invention, the glass transition temperature (Tg) of the toner is typically 40° C. to 70° C., and more preferably 45° C. to 55° C. When the glass transition temperature (Tg) is less than 40° C., heat resistance storage stability of the toner degrades, and when the glass transition temperature (Tg) is more than 70° C., low-temperature fixing property of the toner is insufficient. By making a cross-linked and/or elongated polyester resin coexist with the unmodified polyester resin, the toner for developing electrostatic images can exhibits more excellent storage stability than that of polyester-based toners known in the art, even when the glass transition temperature is low. For the storage elastic modulus of the toner, the temperature (TG') at which the storage elastic modulus of the toner binder at a measurement frequency of 20 Hz is 10,000 dyne/cm$^2$ is typically 100° C. or more, and preferably 110° C. to 200° C. When the temperature (TG') of the toner binder is less than 100° C., anti-hot-offset property degrades. For the viscosity of the toner, the temperature (Tη) of the toner at which the viscosity of the toner binder at a measurement frequency of 20 Hz is 1,000 poise is typically 180° C. or less, and preferably 90° C. to 160° C. When the temperature (Tη) of the toner is more than 180° C., low-temperature fixing property degrades. Thus, from the perspective of obtaining satisfactory low-temperature fixing property and anti-hot-offset property, the temperature (TG') is preferably higher than the temperature (Tη). In other words, the difference in temperature between TG' and Tη (TG'−Tη) is preferably 0° C. or more, more preferably 10° C. or more, and particularly preferably 20° C. or more. The upper limit of the difference in temperature between TG' and Tη (TG'−Tη) is not particularly limited. Further, from the perspective of obtaining satisfactory heat resistance storage stability and low-temperature fixing property, the difference in temperature between TG' and Tη (TG'−Tη) is preferably 0° C. to 100° C., more preferably 10° C. to 90° C., and particularly preferably 20° C. to 80° C.

(Colorant)

For the colorants used in the present invention, dyes and pigments known in the art can be used, and examples thereof include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and mixtures thereof. The content of colorants in the toner is typically 1% by weight to 15% by weight, and preferably 3% by weight to 10% by weight.

The colorants used in the present invention may be used as a complex masterbatch compound with resins. Example of binder resins kneaded in the course of production of the masterbatch or kneaded together with the masterbatch include, besides the above-mentioned modified polyester resins and unmodified polyester resins, styrenes such as styrene polystyrenes, poly-p-chlorostyrenes, and polyvinyl toluenes or polymers of derivative substitution thereof; styrene copolymers such as styrene-p-chlorostyrene copolymers, styrene-propylene copolymers, styrene-vinyltoluene copolymers, styrene-vinylnahthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymer, styrene-acrylonitrile copolymers, styrene-vinylmethyl-keton copolymers, styrene-butadiene copolymers, styrene-isoprene copolymers, styrene-acrylonitrile-indene copolymers, styrene-maleic acid copolymers, and styrene-ester maleate copolymers; polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic resins, rosins, modified rosins, terpene resins, aliphatic or alicyclic hydrocarbon resins, aromatic petroleum resins, chlorinated paraffins, and paraffin waxes. Each of these binder resins may be used alone or in combination with two or more.

The masterbatch may be produced by applying a high shearing force to the resins for the masterbatch and the colorants and mixing or kneading the components. To improve the interaction between the colorants and the resins, an organic solvent may be added thereto. Besides, a so-called flashing process is preferably employed, because in the flashing process, a wet cake of colorants can be directly used without the necessity of drying. In the flashing process, a colorant-water-paste containing water is mixed and kneaded with resins and an organic solvent to transfer the colorants to the resins and then to remove the moisture and the organic solvent components. For the mixing and kneading, a high shearing dispersion unit such as a triple roll mill is preferably used.

(Releasing Agent)

To the toner of the present invention, waxes may be included together with the toner binder and the colorants. Waxes known in the art may be used in the toner, and examples thereof include polyolefin waxes such as polyethylene waxes, and polypropylene waxes; long-chain hydrocarbons such as paraffin waxes, and sazol waxes; and carbonyl group-containing waxes. Of these, carbonyl group-containing waxes are preferably used. Examples of the carbonyl group-containing waxes include polyalkanoic acid esters such as carnauba waxes, montan waxes, trimethylolpropane tribehenate, pentaerythritol tetrabehenate, pentaerythritol diacetate dibehenate, glycerin behenate, and 1,18-octadecandiol distearate; polyalkanol esters such as tristearyl trimellitate, and distearyl maleate; polyalkanoicamides such as ethylene diamine dibehenylamides; polyalkylamides such as tristearylamide trimellitate; and dialkylketones such as distearylketone.

Of these carbonyl group-containing waxes, polyalkanoic acid esters are preferably used.

The melting point of the wax used in the present invention is typically 40° C. to 160° C., preferably 50° C. to 120° C., and more preferably 60° C. to 90° C. A wax having a melting point less than 40° C. is liable to negatively affect heat resistance storage stability, and a wax having a melting point more than 160° C. is liable to cause cold offset in fixing at low temperatures. The melting viscosity of the wax is preferably 5 cps to 1,000 cps as a measurement value at a temperature 20° C. higher than the melting point, and more preferably 10 cps to 100 cps. A wax having a melting viscosity more than 1,000 cps is ineffective in enhancing the effects of anti-hot-offset property and low-temperature fixing property. The content of the wax in the toner is typically 0% by weight to 40% by weight, and preferably 3% by weight to 30% by weight.

(Charge Controlling Agent)

In the toner of the present invention, a charge controlling agent can be included in accordance with the necessity. For the charge controlling agent, those known in the art can be used, and examples thereof include nigrosine dyes, triphenylmethane dyes, chrome-containing metallic complex dyes, molybdic acid chelate pigments, rhodamine dyes, alkoxy amines, quaternary ammonium salts (including fluorine-modified quaternary ammonium salts); alkylamides, phosphoric simple substance or compounds thereof, tungsten simple substance or compounds thereof, fluorine activator, salicylic acid metallic salts, and salicylic acid derivative metallic salts.

Specifically, examples of the controlling agents include Bontron 03 being a nigrosine dye, Bontron P-51 being a quaternary ammonium salt, Bontron S-34 being a metal-containing azo dyes, Bontron E-82 being an oxynaphthoic acid metal complex, Bontron E-84 being a salicylic acid metal complex, and Bontron E-89 being a phenol condensate (manufactured by Orient Chemical Industries, Ltd.); TP-302 and TP-415 being a quaternary ammonium salt molybdenum metal complex (by Hodogaya Chemical Co.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (by Hoechst Corporation); LRA-901, and LR-147 being a boron metal complex (by Japan Carlit Co., Ltd.); copper phthalocyanine, perylene, quinacridone, azo pigments, and other high-molecular mass compounds having a functional group such as sulfonic acid group, carboxyl group, and quaternary ammonium salt.

The amount of the charge controlling agent used in the present invention is determined depending on the type of the binder resin, presence or absence of additives used in accordance with the necessity, and the toner production method including the dispersion process and is not limited uniformly, however, preferably, relative to 100 parts by weight of the binder resin, the charge controlling agent is used in the range from 0.1 parts by weight to 10 parts by weight, and more preferably in the range from 0.2 parts by weight to 5 parts by weight. When the usage amount of the charge controlling agent is more than 10 parts by weight, charge property of the toner is exceedingly large, which reduces the effect of the primarily used charge controlling agent, and electrostatic suction force to developing rollers increases, resulting in lessened flowability of the developer and reduced image density. The charge controlling agent may be dissolved and dispersed in the toner material after kneading the masterbatch and resins. The charge controlling agent may also be directly added to the organic solvent at the time of dissolving and dispersing the toner material. In addition, the charge controlling agent may be added and fixed onto surfaces of toner particles after producing the toner particles.

(Resin Fine Particles)

In the present invention, resin fine particles may be included in the toner materials in accordance with the necessity. The resin fine particles to be used more preferably have a glass transition temperature (Tg) of 40° C. to 100° C. and a weight average molecular weight of 9,000 to 200,000. As described above, when the toner has a glass transition temperature (Tg) less than 40° C., and/or a weight average molecular weight less than 9,000, storage stability of the toner degrades, which causes blocking during storage in the image developing unit. When the toner has a glass transition temperature (Tg) more than 100° C., and/or a weight average molecular weight more than 200,000, adhesiveness of the resin fine particles to fixing paper sheets is impaired, which increases lower limit fixing temperature.

It is more preferable that the residual ratio of the resin fine particles to the toner particles is controlled within the range of 0.5% by weight to 5.0% by weight. When the residual ratio is less than 0.5% by weight, storage stability of the toner degrades, and blocking occurs in the image developing unit during storage. When the residual amount of the resin fine particles in the toner particles is more than 0.5% by weight, the resin fine particles inhibit exudation of wax, and effect of releasing property of the wax cannot be obtained, and offset occurs.

As for the residual ratio of the resin fine particles, the substance attributable to the resin fine particles, not attributable to toner particles, is analyzed using a pyrolysis gas chromatographic mass spectrometer, and the residual ratio of the resin fine particles can be calculated and determined from the peaked area of the analyzed substance. For the detector, a mass spectrometer is preferably used, however, there is no limitation on it.

For the resin fine particles, resins known in the art may be used, provided that the resin can form an aqueous dispersion product, and thermoplastic resins and thermosetting resins may be used. Examples of the resin fine particles include vinyl resins, polyurethane resins, epoxy resins, polyester resins, polyamide resins, polyimide resins, silicon resins, phenol resins, polycarbonate resins, melamine resins, urea resins, aniline resins, ionomer resins, and polycarbonate resins. Each of these resins may be used alone or in combination of two or more. Of these resins, vinyl resins, polyurethane resins, epoxy resins, polyester resins, or resins combined thereof are preferably used from the perspective that an aqueous dispersion product of resin particles formed in a microscopically spherical shape is easily obtained.

Examples of the vinyl resins include polymers of monopolymerized vinyl monomers or copolymerized vinyl monomers such as styrene-(meth)acrylic ester resins, styrene-butadiene copolymers, (meth)acrylic acid-acrylic ester polymers, styrene-acrylonitrile copolymers, styrene-maleic acid anhydride copolymers, and styrene-(meth)acrylic acid copolymers.

(Preparation of Toner Binder)

T toner binder can be prepared by the following method and the like. Polyol (1) and polycarboxylic acid (2) are heated at temperatures from 150° C. to 280° C. in the presence of an esterification catalyst known in the art such as tetrabutoxytitanate and dibutyltin oxides with reducing pressure in accordance with the necessity to remove produced water to thereby obtain a hydroxyl group-containing polyester. Next, the hydroxyl group-containing polyester is reacted with polyisocyanate (3) at temperatures from 40° C. to 140° C. to thereby obtain an isocyanate-containing prepolymer (A).

A dry toner or the present invention can be produced by the following method, however, it will be understood that the present invention is not construed as being limited thereto.

(Method for Producing a Toner in an Aqueous Medium)

In the present invention, the resin fine particles are preliminarily added to an aqueous phase for use. Water used for the aqueous phase may be water alone, or a water-miscible solvent may also be used in combination with water. Examples of the water-miscible solvent include alcohols such as methanol, isopropanol, and ethylene glycol; dimethylformamide, tetrahydrofuran, Cellosolves such as methyl cellosolve; and lower ketones such as acetone, and methyl ethyl ketone.

As for the toner particles of the present invention, a dispersion which contains an isocyanate group-containing prepolymer (A) dissolved or dispersed in an organic solvent is reacted with amines (B) in an aqueous phase. A filter cake is obtained from the obtained emulsified slurry, and a fluoride compound is mixed to and made to adhere on the filter cake to thereby obtain toner particles. In this method, it is preferable that other resin binder components such as waxes, colorants, and unmodified polyester are mixed during the reaction between the dispersion and amines. The weight ratio between a modified polyester (i) and unmodified polyester (ii) is preferably 5/95 to 80/20. For a method for stably forming a dispersion containing the polyester prepolymer (A) in the aqueous phase, for example, there is a method in which a composition of toner initial materials containing polyester prepolymer (A) dissolved or dispersed in an organic solvent is added to the aqueous phase, and the mixture is dispersed by applying a shearing force thereto.

In addition, for the toner of the present invention, it is preferable that conventionally well-known resin binders, for example, vinyl polymer resins such as styrene polymer resins, and polyol resins are used as the toner binder. In this case, similarly to the above noted, resin binder components are mixed along with other toner components such as colorants to form toner particles, and a fluoride compound is mixed to and made to adhere on the toner particles.

The polyester prepolymer (A) dissolved or dispersed in an organic solvent may be mixed with other toner components such as colorants, colored masterbatch, releasing agent, controlling agent, and unmodified polyester resin (referred to as toner initial materials) when the dispersion is formed in an aqueous phase, however, it is preferable that the polyester prepolymer (A) is preliminarily mixed with the toner initial materials, the mixture is dissolved or dispersed in an organic solvent, and then the mixture of the toner materials is added to an aqueous phase to be dispersed.

In the present invention, other toner initial materials such as colorants, releasing agent, and controlling agent are not necessarily mixed when toner particles are formed in an aqueous phase, and after the toner particles are formed, other toner initial materials may be added the toner particles. For example, particles not containing colorants are formed, and then colorants may be added to the particles by a dyeing method known in the art.

The dispersion method is not particularly limited, and the conventional dispersing units may be used. Examples of the dispersing units include a low-speed-shear dispersing unit, a high-speed-shear dispersing unit, a friction dispersing unit, a high-pressure-jet dispersing unit, an ultrasonic dispersing unit. Among them, a high-speed-shear dispersing unit is preferable in terms of the capability of controlling particle diameter of the dispersion from 2 μm to 20 μm. When a high-speed-shear dispersing unit is used, the rotation speed is not particularly limited, however, it is typically 1,000 rpm to 30,000 rpm, and preferably 5,000 rpm to 20,000 rpm. The dispersion time is not particularly limited, and when a batch method is employed, it is typically 0.1 minute to 5 minutes. The dispersion temperature is typically 0° C. to 150° C. under pressures, and preferably 40° C. to 98° C. The dispersion temperature is preferable to be higher in that the viscosity of the dispersion containing the prepolymer (A) is low, and the dispersion is easily dispersed.

The amount of the aqueous phase to be used relative to 100 parts of the toner composition containing the polyester prepolymer (A) is typically 50 parts by weight to 2,000 parts by weight, and preferably 100 parts by weight to 1,000 parts by weight. When the usage amount of the aqueous medium is less than 50 parts by weight, dispersed conditions of the toner composition is poor, and toner particles having a predetermined particle diameter cannot be obtained. When the usage amount is more than 2,000 parts by weight, it is costly. In addition, a dispersing agent may be preferably used in accordance with the necessity in order to sharpen the particle size distribution of the dispersed particles and to stabilize the dispersed particles.

For dispersing agents used for emulsifying and dispersing an oil phase in which the toner composition is dispersed in the aqueous phase, there are, for example, anionic surfactants such as alkylbenzene sulphonates, α-olefin sulphonates, and phosphoric esters; cationic surfactants of amine salts such as alkyl amine salts, aminoalcohol fatty acid derivatives, polyamine fatty acid derivatives, and imidazolines, and cationic surfactants of quaternary ammonium salts such as alkyltrimethyl ammonium salts, dialkyldimethyl ammonium salts, alkyldimethyl benzyl ammonium salts, pyridinium salts, alkyl isoquinolinium salts, and benzethonium chlorides; nonionic surfactants such as fatty amide derivatives, and polyvalent alcohol derivatives; for example, alanine, dedecyldi(aminoethyl)glycine, di(octylaminoethyl) glycine; and amphoteric surfactants such as N-alkyl-N, N-dimethyl ammonium betaine.

Further, by using a surfactant having a fluoroalkyl group, it is possible to emulsify and disperse the oil phase into the dispersion liquid with an extremely small amount thereof. Preferred examples of the anionic surfactant having a fluoroalkyl group include fluoroalkyl carboxylic acid having 2 to 10 carbon atoms or metallic salts thereof, disodium perfluorooctanesulfonylglutamate, sodium-3-{omega-fluoroalkyl ($C_6$ to $C_{11}$)oxy}-1-alkyl($C_3$ to $C_4$)sulfonate, sodium-3-{omega-fluoroalkanoyl($C_6$ to $C_8$)-N-ethylamino}-1-propanesulfonate, fluoroalkyl($C_{11}$ to $C_{20}$)carboxylic acid or metallic salts thereof, perfluoroalkyl($C_7$ to $C_{13}$)carboxylic acid or metallic salts thereof, perfluoroalkyl($C_4$ to $C_{12}$) sulfonic acid or metallic salts thereof, perfluorooctanesulfonic acid diethanol amide, N-propyl-N-(2-hydroxyethyl) perfluorooctanesulfone amide, perfluoroalkyl($C_6$ to $C_{10}$) sulfoneamide propyltrimethylammonium salts, a salt of perfluoroalkyl($C_6$ to $C_{10}$)-N-ethylsulfonyl glycine, monoperfluoroalkyl($C_6$ to $C_{16}$)ethylphosphate.

Examples of the commercially available surfactants having a fluoroalkyl group are Surflon S-111, S-112 and S-113 (manufactured by Asahi Glass Co.); Frorard FC-93, FC-95, FC-98 and FC-129 (manufactured by Sumitomo 3M Ltd.); Unidyne DS-101 and DS-102 (manufactured by Daikin Industries, Ltd.); Megafac F-110, F-120, F-113, F-191, F-812 and F-833 (manufactured by Dainippon Ink and Chemicals, Inc.); ECTOP EF-102, 103, 104, 105, 112, 123A, 123B, 306A, 501, 201 and 204 (manufactured by Tohchem Products Co.); Futargent F-100 and F150 (manufactured by Neos Co.).

Examples of the cationic surfactants include primary, secondary or secondary aliphatic amines having a fluoroalkyl group, aliphatic quaternary ammonium salts such as perfluoroalkyl($C_6$ to $C_{10}$)sulfone amide propyltrimethylammonium salt, benzalkonium salt, benzetonium chloride, pyridinium salt, and imidazolinium salt. Specific examples of the commercially available products thereof are Surflon S-121 (manufactured by Asahi Glass Co.), Frorard FC-135 (manufactured by Sumitomo 3M Ltd.), Unidyne DS-202 (manufactured by Daikin Industries, Ltd.), Megaface F-150 and F-824 (manufactured by Dainippon Ink and Chemicals, Inc.), Ectop EF-132 (manufactured by Tohchem Products Co.), and Futargent F-300 (manufactured by Neos Co.).

It is also possible to use water-insoluble inorganic dispersants such as calcium phosphates, calcium carbonates, titanium oxides, colloidal silicas, and hydroxyl apatites.

In addition, polymeric protective colloids may be used to stabilize the dispersed droplets. Examples of the polymeric protective colloids include acids such as acrylic acids, methacrylic acids, α-cyanoacrylic acids, α-cyanomethacrylic acids, itaconic acids, crotonic acids, fumaric acids, maleic acids, and maleic anhydrides; (meth)acryl monomers having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl acrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamido, and N-methylol methacrylamide; vinyl alcohols or esters with vinyl alcohols such as vinyl methyl ethers, vinyl ethyl ethers, and vinyl propyl ethers; or esters of vinyl alcohol and a compound having a carboxyl group such as vinyl acetates, vinyl propionates, and vinyl butyrates; amide compounds or methylol compounds thereof such as acryl amides, methacryl amidse, diacetone acrylic amide acids, or methylols thereof; chlorides such as acrylic chlorides, and methacrylic chloride; honopolymers or copolymers having a nitrogen atom or heterocyclic ring thereof such as vinyl pyridines, vinyl pyrrolidone, vinyl imidazole, and ethylene imine; polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylarylphenyl ester, and polyoxyethylene nonylphenyl ester, and celluloses such as methyl cellulose, hydroxyethyl cellulose, and hydroxypropyl cellulose.

When acids such as calcium phosphate or alkaline-soluble substance is used as a dispersion stabilizer, calcium phosphate is dissolved by effect of acids such as hydrochloric acid and then washed with water or decomposed by an enzyme to thereby remove calcium phosphate from fine particles.

When dispersing agents are used, they may be left to remain on surfaces of the toner particles, however, it is preferred that the dispersing agents be washed and removed after the elongation and/or cross-linking reaction from the perspective of charge property of the toner.

The reaction time for elongation and/or cross-linking is selected depending on reactivity in accordance with the combination of the structure of the isocyanate group contained in the polyester prepolymer (A) and amines (B), however, the reaction time is typically 10 minutes to 40 hours, and preferably 2 hours to 24 hours. The reaction temperature is typically 0° C. to 150° C., and preferably 40° C. to 98° C. Conventional catalysts may be used in accordance with the necessity, and specific examples thereof include dibutyltin laurate, and dioctyltin laurate.

To remove the organic solvent from the obtained emulsified dispersion, it is possible to employ a method in which the entire system is raised gradually so as to completely evaporate and remove the organic solvent in the droplets. Alternatively, it is also possible to spray the emulsified dispersion in dry atmosphere and completely remove the water-insoluble organic solvent in the droplets to form toner fine particles to thereby evaporate and remove the aqueous dispersing agents at the same time. For the dry atmosphere into which the emulsified dispersion is sprayed, heated gases yielded by heating air, nitrogen gas, carbon dioxide gas, combustion gas, and the like, or various flows or streams heated at temperatures higher than the boiling point of a specific solvent having the highest boiling point among the solvents are typically used. It is possible to obtain a satisfactory and desired quality of toner in a short time process using a spray dryer, a belt dryer, a rotary kiln, or the like.

Alternatively, as a method for removing the organic solvent from the emulsified dispersion, it is also possible to insufflate air to the emulsified dispersion using a rotary evaporator or the like.

Thereafter, the toner particles are coarsely separated by means of a centrifuge, washed in a washing tank, and repeatedly dried in a hot-air dryer, and finally a fluoride compound is made to adhere on or chemically bounded to surfaces of the toner particles in an aqueous solvent tank with a fluoride compound dispersed therein (preferably surfactant-containing water), and then subjected to a removal of the organic solvent and drying to thereby obtain toner base particles.

When particles size distribution of toner particles is wide, and the toner particles are washed and dried in a condition where the particle size distribution is held as it is, the toner particles can be classified into a desired particle size distribution, and the particle size distribution can be narrowed. In the operation of classifying the toner particles, fine particles can be removed from the toner particles even in an aqueous solution by using a cyclone, a decanter, and centrifuge separator. Of course, toner particles may be classified after the toner particles have been dried and yielded as powder, however, it is preferable to classify the toner particles in an aqueous solution in terms of efficiency. The obtained unnecessary fine particles or coarse particles can be returned to the kneading process again to use them in formation of toner particles. In this case, the fine particles or coarse particles may be in wet conditions.

It is preferred to remove the used dispersing agents from the obtained dispersion as much as possible, and the removal of dispersing agents is preferably performed concurrently with the operation of classification.

In the present invention, it is also possible to subject a pulverized toner to a surface treatment with a fluoride compound. A pulverized toner can be produced as described below.

(Method for Producing a Pulverized Toner)

A method for producing a toner can be applied, in which the method includes mechanically mixing developer components containing a binder resin, a pigment (a charge controlling agent in accordance with necessity); fusing and kneading; pulverizing; and classifying. In addition, a method for producing a toner is also included, in which powder or particles other than the particles obtained in the pulverizing and the classifying to be used as products are returned to the steps of the mechanically mixing and the fusing and kneading to reuse the particles for production.

The said powder or particles other than particles to be used as product (by-product) means fine particles and coarse particles other than toner components having desired particle diameters obtained in the pulverizing step after going through the fusing and kneading to be used as product or fine particles and coarse particles other than toner components having desired particle diameters generated in the classifying successively performed to be used as product. In mixing, fusing and kneading such by-product, it is preferable that such by-product be mixed with other toner initial materials at a weight ratio of by-product to other toner initial materials of 1:99 to 50:50.

In mechanically mixing developer components containing a binder resin, a pigment (a charge controlling agent in accordance with the necessity), and by-product, the developer components may be mixed using a typically used mixer having blades to rotate the contents under normal conditions, and there is no limitation on the mixing method and mixing conditions.

After the mixing is completed, the developer components are poured to a kneader to be fused and kneaded. For a fusion-kneader, uniaxial or two-axis continuous kneader, batch kneader using a roll mill may be used. For example, preferred examples of the kneader include KTK type two-axis extruder manufactured by KOBE STEEL. Ltd.; TEM type extruder manufactured by TOSHIBA MACHINE CO., LTD.; two-axis extruder manufactured by KCK Co., Ltd.; PCM type two-axis extruder manufactured by IKEGAI LTD.; Cokneader manufactured by BUSS Company.

It is important to perform the fusion and kneading under appropriate conditions so as not to break the molecular chains of the binder resin. Specifically, the temperature of the developer components in the fusing and kneading should be determined with reference to the softening point of the binder resin. When the temperature is excessively lower the softening point, breaking of the molecular chains is fierce, and when the temperature is excessively higher the softening point, the dispersion is decelerated. When the amount of volatile components in the toner is controlled, it is preferred that optimal conditions of the temperature, time, and atmosphere in the fusing and kneading be set while monitoring the residual amount of the volatile components at that time.

When the fusing and kneading is completed, the kneaded materials are pulverized. In the pulverizing, it is preferable that the kneaded materials be coarsely pulverized first and then finely pulverized. In the pulverization, a method of which the kneaded materials is crashed against a collision plate in a jet stream to thereby pulverize the kneaded materials, and a method of which the kneaded materials is pulverized by means of a gap between a mechanically rotating rotator and a stirrer.

After the pulverizing is completed, the pulverized materials are classified in a airflow by utilizing a centrifugal force and the like to thereby produce a toner (toner base particles) having a predetermined particle diameter, for example, a volume average particle diameter of 2 μm to 20 μm. The toner preferably has a volume average particle diameter of 2 μm to 7 μm in that transfer dust caused when the toner is transferred and fixed can be prevented, and the toner can sufficiently exert its tinting. In addition, it is effective in preventing toner scattering and background smear. Further, it is preferable from the perspective of quality of images, production cost, coverage of external additives, and the like. The volume average particle diameter of toner can be measured using COULTER TA-II (COULTER ELECTRONICS, INC.).

Then, a fluoride compound is made to adhere on or reacted with surfaces of the toner base particles by means of dry-mixing or wet-process (using a solvent, water, or a mixture thereof) to be in a state where the fluoride compound exists on the toner surface. Alternatively, the fluoride compound is preliminarily mixed in the toner base particles so as to make a part of the fluoride compound unevenly located on the toner surface.

To the thus obtained toner, inorganic fine particles such as oxide fine particles, hydrophobic silica fine power may be further added to be mixed. For mixing external additives, a typical mixer for powder is used, and it is preferable that the mixer be equipped with a jacket or the like so as to control the inside temperature thereof. In order to change history of load given to the external additives, the external additive may be added to the mixer halfway or little by little. Of course, the rotation speed, rolling speed, time, temperature, or other conditions of the mixer may be changed. A strong load may be given to the mixer first, and then relatively weak load may be given to the mixer, and vice versa.

Examples of the usable mixing equipment include V-type mixer, rocking mixer, Loedige mixer, Nauta mixer, and HENSCHEL MIXER.

By mixing the obtained dried toner powder with heterogeneous particles such as releasing agent fine particles, charge controlling fine particles, fluidizer fine particles, and colorant fine particles or by applying a mechanical impulse force to the mixed power to solidify and fuse heterogeneous particles on the surfaces of toner particles to thereby prevent desorption of the heterogeneous particles from the surfaces of the obtainable complex particles.

Examples of the specific method include a method in which an impulse force is applied to the mixture by means of rotating blades at high speed; and a method in which the mixture is introduced in a fast gas stream, and the stream speed is accelerated to crash the particles with each other or to make the complex particles crashed against an appropriate collision plate. Examples of the equipment include apparatuses of which Angmill (manufactured by Hosokawa micron Co., Ltd.), or I-type mill (manufactured by Nippon Pneumatic Manufacturing Co., Ltd.) is remodeled to reduce powder pulverizing air pressure, hybridization system (manufactured by NARA MACHINERY CO., LTD.), Cryptron system (manufactured by KAWASAKI HEAVY INDUSTRIES, LTD.), and automatic mortar.

Finally, external additives such as inorganic fine particles (particularly including inorganic fine particles subjected to a surface treatment with hydrophobized silica) and the toner are mixed each other using HENSCHEL MIXER or the like, and coarse particles are removed from the mixed particles through an ultrasound sieve to thereby obtain a conclusive toner.

Besides, for other methods for producing a toner, polymerization method, capsulation method, or the like may be used. Outlines of these production methods are described below.

<Polymerization> a) a polymerized monomer, and in accordance with the necessity, polymerization initiator, colorants, wax, or the like are granulated in an aqueous dispersion medium.
b) the granulated monomer composition particles are classified so as to have proper particle diameters.
c) the monomer composition particles having specified particle diameters obtained from the classification is polymerized.
d) the thus obtained polymerized product is subjected to a proper treatment to remove the dispersing agent, and then the polymerized product is filtered, washed, and dried to thereby obtain toner base particles.

<Capsulation> a) a resin, and in accordance with the necessity, colorants or the like are kneaded to obtain a molten toner core material.
b) the toner core material is put in water and strongly stirred ton prepare a core material in a state of fine particles.
c) the core material fine particles are put into a shell material solution, a poor solvent is titrated to the core and shell material mixed solution while stirring the core and shell material mixed solution so as to cover the surface of the core material with the shell material, thereby perform capsulation.
d) the thus obtained capsulated materials are filtered and dried to thereby obtain toner base particles.

(Carrier for Two-Component Developer)

When the toner of the present invention is used in a two-component developer, the toner may be mixed with a magnetic carrier. The content ratio of the carrier to the toner in the developer is preferably 1 part by weight to 10 parts by weight relative to 100 parts by weight of the carrier. For the magnetic carrier, those known in the art, for example, iron powders, ferrite powders, magnetite powders, and magnetic resin carriers each having a particle diameter of 20 μm to 200 μm can be used. Examples of coating materials for coating the magnetic carrier include amino resins, for example, urea-formaldehyde resins, melamine resins, benzoguanamine resins, urea resins, polyamide resins, and epoxy resins.

In addition, it is also possible to use polyvinyl resins and polyvinylidene resins such as acrylic resins, polymethyl methacrylate resins, polyacrylonitrile resins, polyvinyl acetate resins, polyvinyl alcohol resins, polyvinyl butyral resins; polystyrene resins, and polystyrene resins such as styrene-acryl copolymer resins; halogenated olefin resins such as polyvinyl chlorides; polyester resins such as polyethylene terephthalate resins, and polybutylene terephthalate resins, polycarbonate resins, polyethylene resins, polyvinyl fluoride resins, polyvinylidene fluoride resins, polytrifluoro ethylene resins, polyhexafluoro-propylene resins; copolymers of vinylidene fluoride and an acryl monomer; fluoro-tar polymers such as tar polymers of tetrafluoro-ethylene, vinylidene fluoride and a non-fluorinated monomer; and silicone resins.

In accordance with the necessity, conductive powder or the like may be included in the coating resins. For the conductive powder, metal powders, carbon black, titanium oxides, tin oxides, and zinc oxides or the like can be used. These conductive powders preferably have an average particle diameter of 1 μm or less. When the average particle diameter of the conductive powder is greater than 1 μm, it is difficult to control electric resistivity.

In addition, the toner of the present invention can be used as a one-component magnetic toner without using carrier therein, or as a non-magnetic toner.

(Image Forming Apparatus)

The image forming apparatus of the present invention is equipped with a photoconductor, a charging unit configured to charge the photoconductor, an exposing unit configured to expose the photoconductor charged by the charging unit with a write laser beam to form a latent electrostatic image, and a developing unit with a developer loaded therein configured to develop the latent electrostatic image into a visible image by supplying the developer to the photoconductor to thereby form a toner image, and a transferring unit configured to transfer the toner image formed by the developing unit onto a transferring material. The developer contains the toner for developing electrostatic images of the present invention and a carrier containing a magnetic carrier.

(Intermediate Transfer Member)

In the present invention, a toner image formed on the photoconductor can be directly transferred to a final transferring member such as paper media, however, an intermediate transfer member can also be used. Hereinafter, an embodiment of the intermediate transfer member of the transferring system will be described. FIG. 1 is a block diagram schematically showing a copier relating to this embodiment of the present invention. In the copier, photoconductor drum 10, hereinafter it may be referred to as photoconductor 10, serving as an image bearing member, is surrounded by charge roller 20 serving as the charging unit, exposing unit 30, cleaning unit 60 having a cleaning blade, charge-eliminating lamp 70 serving as the charge-eliminating unit, image developing unit 40, and intermediate transfer member 50 serving as an intermediate transfer member. The intermediate transfer member 50 is suspended by a plurality of suspension rollers 51 and configured to be driven in an endless form in the direction indicated by an arrow by action of a drive unit such as a motor (not shown).

A part of suspension rollers 51 also serves as a transfer bias roller for applying a transfer bias to the intermediate transfer member 50. A given transfer bias voltage is applied to the transfer bias roller from a source (not shown). In addition, cleaning unit 90 having a cleaning blade for the intermediate transfer member 50 is also arranged in the copier. Transfer roller 80 is also arranged so as to face the intermediate transfer member 50, and the transfer roller 80 serves as a transferring unit configured to transfer a developed image onto transferring sheet 100 serving as a final transfer member. Corona charger 52 is disposed around the intermediate transfer member 50 as a charging unit.

The image developing unit 40 is provided with developing belt 41 serving as a developer carrier, black (hereinafter represented by Bk) developing unit 45K, yellow (hereinafter represented by Y) developing unit 45Y, magenta (hereinafter referred to as magenta) developing unit 45M, and cyan (hereinafter represented by C) developing unit 45C, all of which are disposed around the developing belt 41. The developing belt 41 is spanned over a plurality of belt rollers and is configured to be driven in an endless form in the direction indicated by an arrow by action of a drive unit such as a motor (not shown) to move at a substantially same speed of the photoconductor 10 at a portion making contact with the photoconductor 10.

Since individual developing units stated above have the same configuration, the following paragraphs will explain only the Bk black developing unit 45K, and for other developing units of 45Y, 45M, and 45C, in the figure, the parts corresponding to those of the Bk developing unit 45K will be represented by just assigning Y, M, or C following the reference numbers same as those of the Bk developing unit 45K, and the explanations for developing units of 45Y, 45M, and 45C will be omitted. The developing unit 45K is provided with developer container 42K for housing a high viscosity and high density liquid developer containing toner particles and carrier solution components, pumping roller 43K which is arranged such that the lower portion thereof is soaked in the liquid developer within the developer container 42K, and coating roller 44K configured to make the developer pumped from the pumping roller 43K a thin layer so as to be coated on the developing belt 41. The coating roller 44K has a conductivity, and a given bias is applied to the coating roller 44K from a source (not shown).

Figure 2:
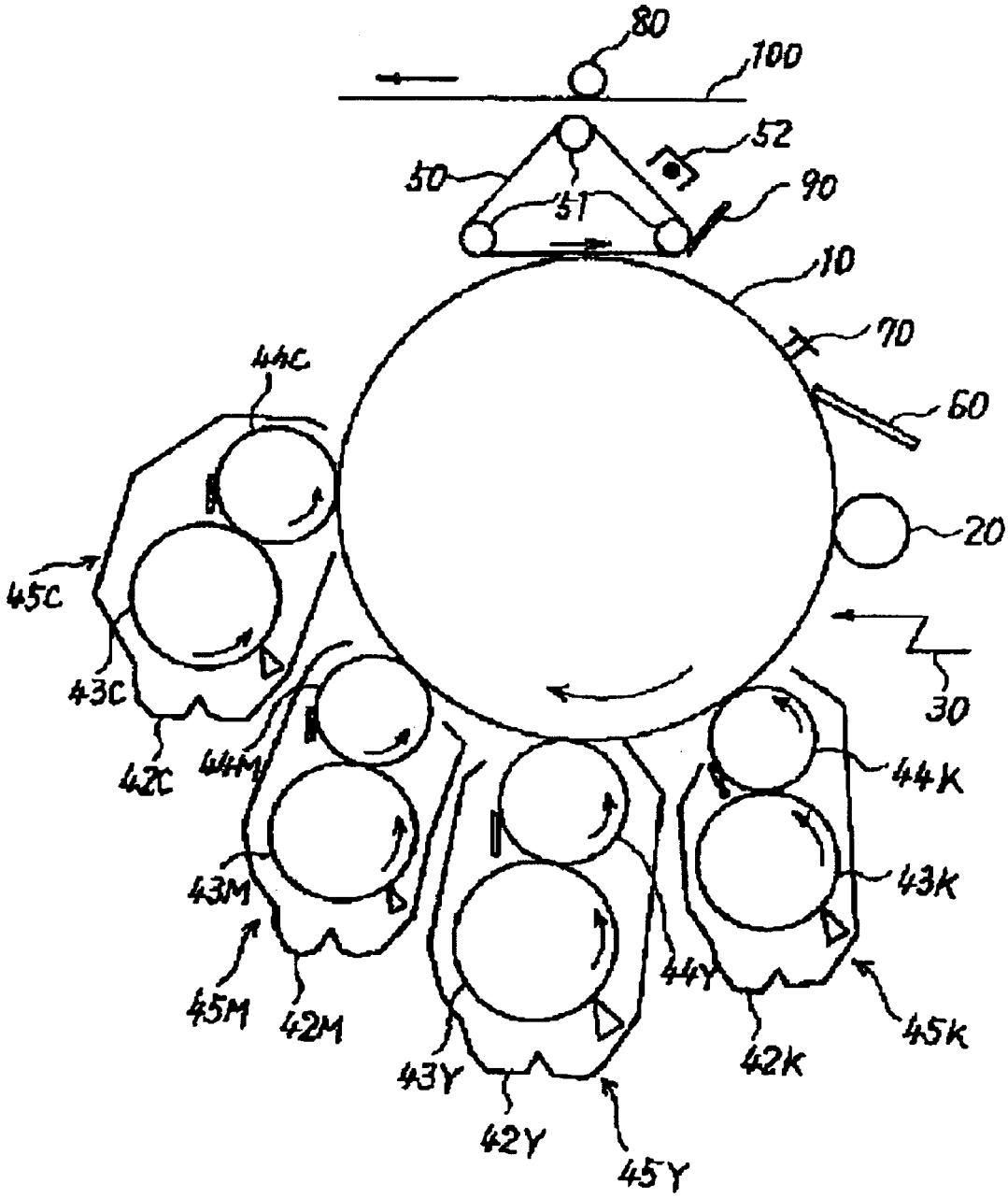
FIG. 2 is a schematic block diagram showing another example of the copier according to an embodiment of the present invention.

Besides the configuration shown in FIG. 1, a copier relating to this embodiment may have a configuration where each color developing units 45K, 45Y, 45M, and 45C are arranged around the photoconductor 10, as shown in FIG. 2.

Next, operations of the copier relating to this embodiment will be described. In FIG. 1, the photoconductor 10 is rotated and driven to move in the direction indicated by the arrow while being uniformly charged by the charge roller 20, and a reflected light from the document is focused and projected through an optical system (not shown) by the exposing unit 30 to form a latent electrostatic image on the photoconductor 10.

This latent electrostatic image is developed by the developing unit 40 and formed into a toner image as a developed image. The pumped thin layer of developer on the developing belt 41 peals off from the surface of the developing belt 41 in a state of a thin layer by making contact with the photoconductor in the developing area to move to the area where the latent electrostatic image has been formed on the photoconductor 10. The toner image developed by the developing unit 40 is transferred onto the surface of the intermediate transfer member 50 (primary transfer) at a contact area between the toner image and the intermediate transfer member 50 (primary transfer area). When three colors or four colors are superimposed to transfer an image, this process is repeated for each of these color toners to form a color image on the intermediate transfer member 50.

The corona charger 52 is placed in a rotational direction of the intermediate transfer member 50 in order to provide charges to the superimposed toner image on the intermediate transfer member at a position that is downstream of the contact section of the photoconductor 10 and the intermediate transfer member 50, and that is upstream of the contact section of the intermediate transfer member 50 and the transferring sheet 100. Then, the corona charger 52 provides a true electric charge to the toner image with the polarity of which is the same as that of the toner particles that form the toner image, and gives a sufficient charge enough to enable an excellent transfer to the transferring sheet 100. After being charged by the corona charger 52, the toner image is transferred at once to the transferring sheet 100 which is carried in the direction indicated by the arrow from a sheet feeder (not shown) by a transfer bias of the transferring roller 80 (secondary transfer). Thereafter, the transferring sheet 100 to which the toner image has been transferred is detached from the photoconductor 10 by a detaching apparatus (not shown). Then, the transferring sheet 100 is fixed by a fixing unit (not shown) and ejected from the detaching apparatus. On the other hand, after the transfer, the cleaning unit 60 removes and retrieves untransferred toner particles from the photoconductor 10, and the charge elimination lamp 70 removes remaining charge from the photoconductor 10 to prepare for the subsequent charging.

The static friction coefficient of the intermediate transfer member is preferably 0.1 to 0.6, more preferably 0.3 to 0.5. The volume resistance of the intermediate transfer member is preferably several Ω·cm or more and $10^3$ Ω·cm or less. By controlling the volume resistance from several Ω·cm to $10^3$ Ω·cm, charging of the intermediate transfer member itself is prevented. It also prevents uneven transfer at secondary transfer because the charge provided by charge-providing unit rarely remains on the intermediate transfer member. In addition, it is easier to apply a transfer bias for the secondary transfer.

The materials for the intermediate transfer member are not particularly limited, and those known in the art may be used. Examples thereof are as follows.

(1) Materials with high Young's moduli (tension elasticity) used as a single layer belt, which include polycarbonates (PC), polyvinylidene fluoride (PVDF), polyalkylene terephthalate (PAT), blend materials of polycarbonates (PC) and polyalkylene terephthalate (PAT), and blend materials such as ethylene tetrafluoroethylene copolymer (ETFE) and polycarbonates (PC), ethylene tetrafluoroethylene copolymer (ETFE) and polyalkylene terephthalate (PAT), and polycarbonates (PC) and polyalkylene terephthalate (PAT); and thermosetting polyimides of carbon black dispersion. These single layer layers having high Young's moduli are small in their deformation against stress during image formation and are particularly advantageous in that mis-registration is not easily caused when forming a color image.

(2) A double or triple layer belt using the above-noted belt having high Young's modulus as a base layer with a surface layer or an intermediate layer added circumferentially around the base layer. The double or triple layer belt has a capability to prevent print defect of unclear center portion in a line image that is caused by the hardness of the single layer belt.

(3) A belt with a relatively low Young's modulus which incorporates a rubber or an elastomer. This belt has an advantage that there is almost no print defect of unclear center portion in a line image due to its softness. Additionally, by making the width of the belt wider than driving and tension rollers and thereby using the elasticity of the edge portions that extend over the rollers, it can prevent snaky move of the belt. Therefore, it can reduce cost without the need of ribs and a device to prevent the snaky move.

Conventionally, intermediate transfer belts have been adopting fluorine resins, polycarbonates, polyimides, and the like, however, in the recent years, elastic belts in which elastic members are used in all layers or a part thereof are used. There are the following problems on transfer of color images using a resin belt. Color images are typically formed with four colors of color toners. In one color image, toner layers of layer 1 to layer 4 are formed. Toner layers are pressurized as they pass the primary transfer in which the toner layers are transferred from the photoconductor to the intermediate transfer belt and the secondary transfer in which the toner is transferred from the intermediate transfer belt to the sheet, which increases the flocculation force among toner particles. As the flocculation force increases, phenomena such as dropouts of letters and dropouts of edges of solid images are likely to occur. Since resin belts are too hard to be deformed by the toner layers, they tend to compress the toner layers and therefore dropout phenomena of letters are likely to occur.

Recently, the demands for printing full color images on various types of paper such as Japanese paper and paper having concavoconvex or irregularities intentionally formed thereon are increasing. However, with sheets of paper having low smoothness, gaps between the toner and the sheet are likely to be formed at the time of transferring and therefore miss-transfers easily occur. When the transfer pressure of secondary transfer section is raised in order to increase the contact, the flocculation force of the toner layers will be higher, resulting in dropouts of letters as described above.

Elastic belts are used for the following aim. Elastic belts deform according to the toner layers and the roughness of the sheet having low smoothness at the transfer section. In other words, since elastic belts deform according to local bumps and holes, an excellent contact is achieved without excessively increasing the transfer pressure against the toner layers so that it is possible to obtain transferred images having excellent uniformity without any dropout of letters even on sheets of paper having a low surface planality.

For the resin of the elastic belts, one or more can be selected from the group consisting of polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like. However, it is understood that the materials are not limited to those mentioned above.

For the rubber and elastomer of the elastic materials, one or more can be selected from the group including butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosufonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers (such as polystyrene elastomers, polyolefin elastomers, polyvinyl chloride elastomers, polyurethane elastomers, polyamide elastomers, polyurea elastomers, polyester elastomers, and fluorine resin elastomers), and the like. However, it is understood that the materials are not limited to those mentioned above.

Electric conductive agents for resistance adjustment are not particularly limited, and examples thereof include carbon black, graphite, metal powders such as aluminum, nickel, and the like; and electric conductive metal oxides such as tin oxide, titanium oxide, antimony oxide, indium oxide, potassium titanate, antimony tin oxide (ATO), indium tin oxide (ITO), and the like. The metal oxides may be coated on non-conducting particulates such as barium sulfate, magnesium silicate, calcium carbonate, and the like. It is understood that the conductive agents are not limited to those mentioned above.

Materials of the surface layer are required to prevent contamination of the photoconductor by use of the elastic material and to reduce the surface friction of the transfer belt so that toner adhesion is lessened and the cleaning ability and secondary transfer property are increased. For example, one or more of polyurethane, polyester, epoxy resin, and the like are used, and powders or particles of a material that reduces surface energy and enhances lubrication such as fluorine resin, fluorine compound, carbon fluoride, titanium dioxide, silicon carbide, or the like can be dispersed and used. Alternatively, powders or particles of different sizes may be employed. In addition, it is possible to use a material such as fluorine rubber that is treated with heat so that a fluorine-rich layer is formed on the surface and the surface energy is reduced.

The method for producing the belt is not limited, and there are:

centrifugal forming in which material is poured into a rotating cylindrical mold to form a belt;

spray application in which a liquid paint is sprayed to form a film;

dipping method in which a cylindrical mold is dipped into a solution of material and then pulled out;

injection mold method in which material is injected between inner and outer molds; and a method in which a compound is applied onto a cylindrical mold and the compound is vulcanized and ground.

The method is not limited to those mentioned above, and typically, an elastic belt is produced in combination of plural methods.

Methods to prevent elongation of the elastic belt include using a core resin layer which is difficult to elongate on which a rubber layer is formed, incorporating a material that prevents elongation into the core layer, and the like, however, the methods are not particularly related with the production methods.

For materials that prevent elongation of a core layer, one or more can be selected from the group including, for example, natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials in a form of a weave or thread can be used. It is understood naturally that the materials are not limited to those described above.

A thread may be one or more of filaments twisted together, and any ways of twisting and plying are accepted such as single twisting, multiple twisting, doubled yarn, and the like. Further, fibers of different materials selected from the above-described group may be spun together. The thread may be treated before use in such a way that it is electrically conductive.

On the other hand, the weave may be of any type including plain knitting. It is naturally possible to use a combined weave to apply electric conductive treatment.

The production method of the core layer is not particularly limited. For example, there is a method in which a weave that is woven in a cylindrical shape is placed on a mold or the like and a coating layer is formed on top of it. Another method uses a cylindrical weave being dipped in a liquid rubber or the like so that on one side or on both sides of the core layer, coating layer(s) is formed. In another example, a thread is wound helically to a mold or the like in an arbitrary pitch, and then a coating layer is formed thereon.

When the thickness of the elastic layer is too thicker, the elongation and contraction of the surface becomes large and may cause a crack on the surface layer although it depends on the hardness of the elastic layer. Moreover, when the amount of elongation and contraction is large, the size of images are elongated and contracted. Therefore, it is not preferred (about 1 mm or more).

(Tandem Type Color Image Forming Apparatus)

Figure 3:
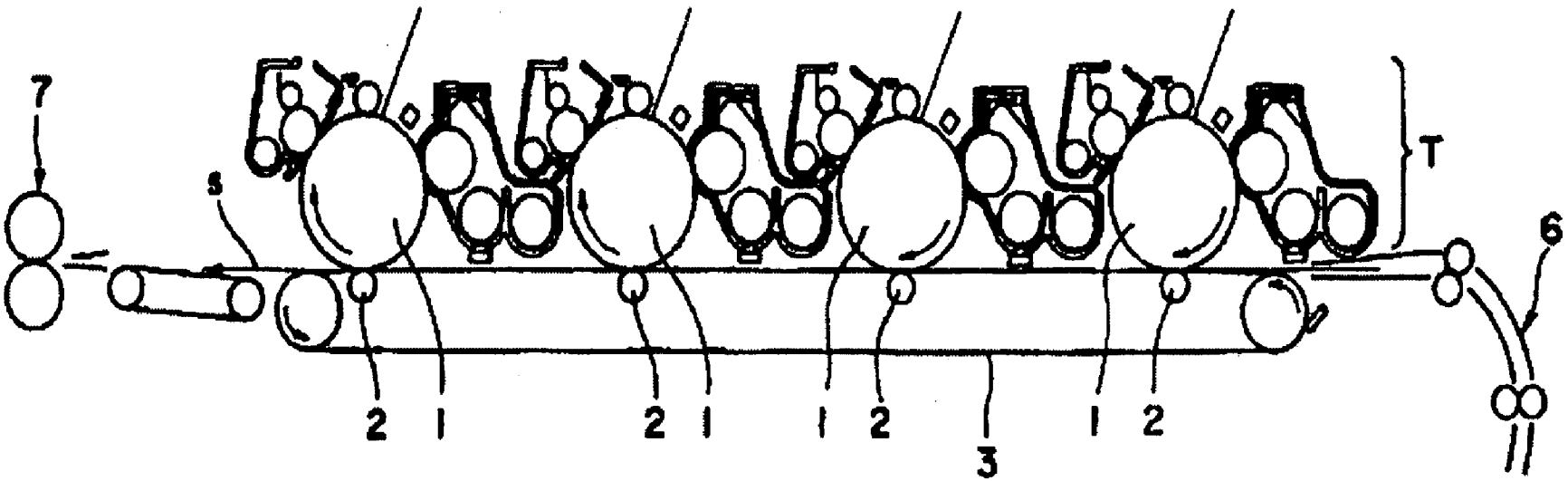
FIG. 3 is a schematic block diagram showing an example of the image forming part of the tandem electrophotographic apparatus according to an embodiment of the present invention.
Figure 4:
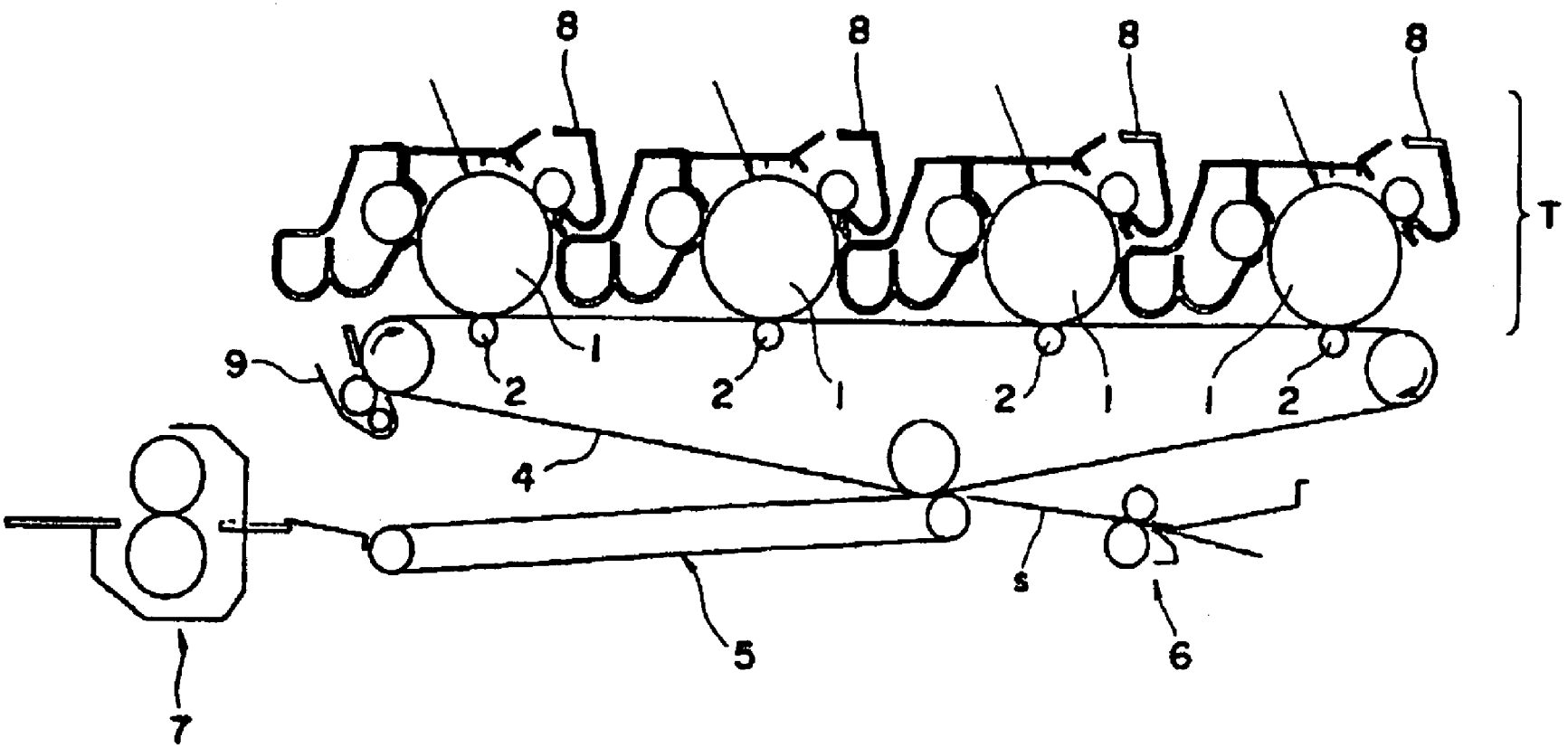
FIG. 4 is a schematic block diagram showing another example of the image forming part of the tandem electrophotographic apparatus according to an embodiment of the present invention the present invention.

The present invention may also be applied to a color-image forming apparatus of a tandem system. An embodiment of such a color-image forming apparatus of the tandem system will be described below. Such tandem electrophotographic apparatus are roughly classified into direct transfer systems and indirect transfer systems. In the direct transfer system as shown in FIG. 3, transferring unit 2 transfers images on individual photoconductors 1 sequentially to a sheet "s" transported by sheet conveyor belt 3. In the indirect transfer system as shown in FIG. 4, primary transferring unit 2 sequentially transfers images on individual photoconductors 1 to intermediate transfer member 4, and secondary transferring unit 5 transfers the resulting images on the intermediate transfer member 4 to the sheet "s" in a block. The secondary transferring unit is formed in a transfer conveyor belt, however, it may be in the form of a roller.

The direct transfer system must be provided with sheet feeder 6 upstream to the sequentially arrayed photoconductors 1 of the tandem image forming apparatus T and fixing unit 7 downstream thereof. This is disadvantageous because the system inevitably increases in its size in a sheet transporting direction.

On the other hand, in the indirect transfer system, the secondary transfer mechanism can be relatively freely arranged, and the sheet feeder 6 and the fixing unit 7 can be arranged above and/or below the tandem image forming apparatus T. The apparatus of the indirect transfer system is advantageous in that it can therefore be downsized.

In the direct transfer system, the fixing unit 7 should be arranged in the vicinity of the tandem image forming apparatus T to prevent upsizing of the apparatus in a sheet transporting direction. There are disadvantages in that the sheet "s" cannot sufficiently bend in such a small space between the fixing unit 7 and the tandem image forming apparatus T, accordingly, image formation upstream to the fixing unit 7 is affected by an impact, specifically in a thick sheet, formed when the tip of the sheet "s" enters the fixing unit 7 and by the difference between the transporting speed of the sheet when it passes through the fixing unit 7 and the transporting speed of the sheet by the transfer conveyor belt.

On the other hand, in the indirect transfer system, the sheet "s" can sufficiently bend in a space between the fixing unit 7 and the tandem image forming apparatus T. Thus, the fixing unit 7 does not significantly affect the image formation.

Based on the reasons stated above, in recent years, particularly, the attention has become drawn from an apparatus which employs indirect transfer technique.

This type of color electrophotographic apparatus, as shown in FIG. 4, photoconductor cleaning unit 8 removes a residual toner remaining on photoconductor 1 after a primary transfer to clean the surface of the photoconductor 1 and prepare for subsequent image forming, and intermediate transfer member cleaning unit 9 removes a residual toner remaining on intermediate transfer member 4 after a secondary transfer to clean the surface of the intermediate transfer member 4 and prepare for the subsequent image forming.

With reference to the figures, an embodiment of the present invention will be described.

Figure 5:
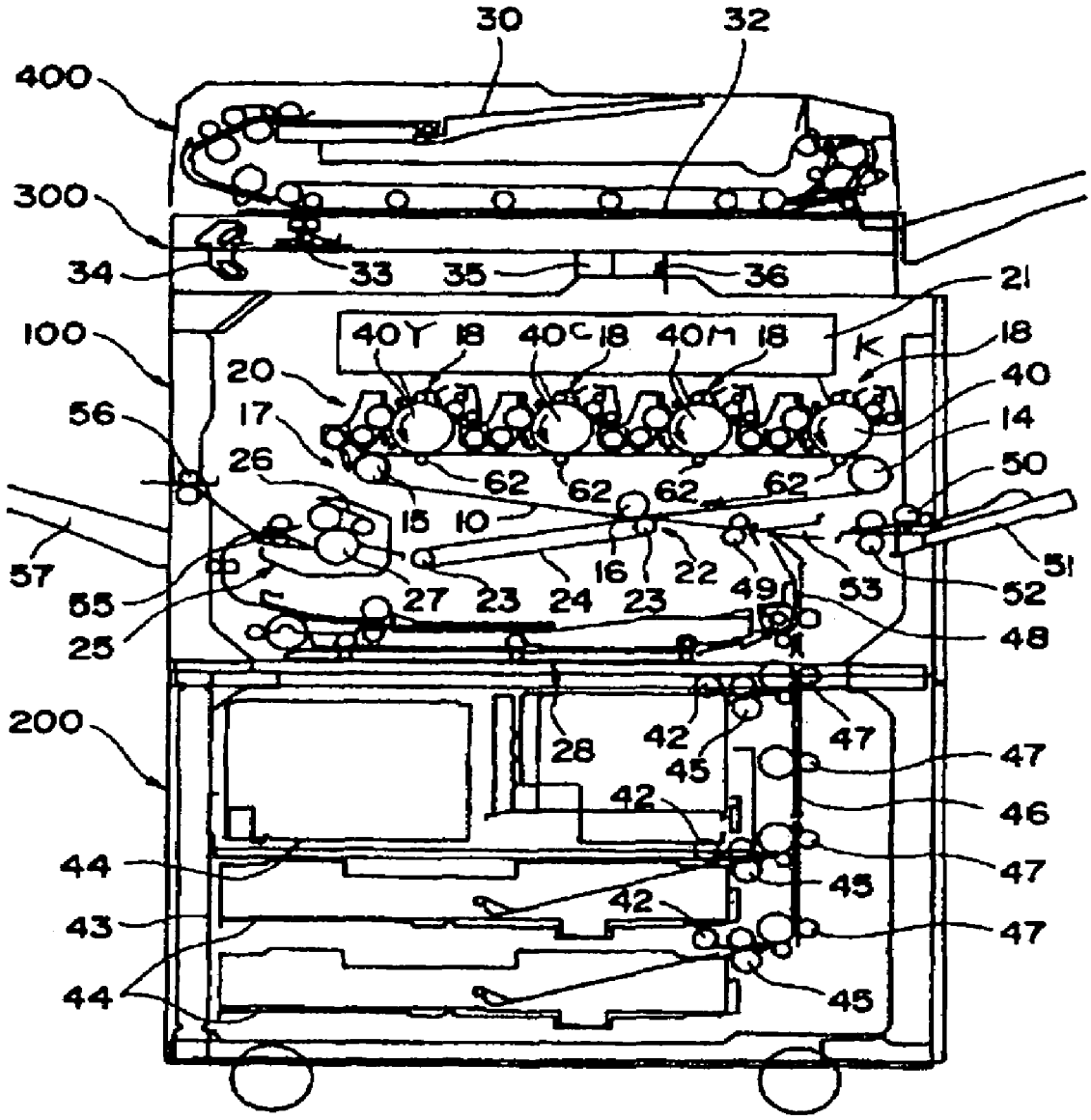
FIG. 5 is a schematic block diagram showing an example of the tandem electrophotographic apparatus according to an embodiment of the present invention.

In FIG. 5, copier main body 100 is provided with sheet feeder table 200, scanner 300 which is mounted on the copier main body 100, and automatic document feeder (ADF) 400 arranged on the scanner 300. Intermediate transferring member 10 formed in an endless belt is arranged at the center of the copier main body 100.

As shown in an illustrated example in FIG. 5, the intermediate transfer member 10 is spanned over three support rollers 14, 15, and 16 and is capable of rotating and moving in a clockwise direction in the figure.

In the illustrated example, on the left side of the second support roller 15 of the three support rollers, intermediate transfer member cleaning unit 17 is arranged, which is capable of removing a residual toner remaining on the intermediate transfer member 10 after image transfer.

Above the intermediate transfer 10 spanned between the first and second support rollers 14 and 15, yellow, cyan, magenta, and black image-forming units 18 are arrayed in parallel in a moving direction of the intermediate transfer member 10 to thereby constitute tandem image forming apparatus 20.

As shown in FIG. 5, the apparatus further includes exposing unit 21 above the tandem image forming apparatus 20 and secondary transferring unit 22 below the intermediate transfer 10. In the illustrated example, secondary transferring belt 24 being formed in an endless belt is spanned over between the two rollers 23 to constitute the secondary transferring unit 22, and the secondary transferring unit 22 is arranged so as to be pressed against the third support roller 16 through the intermediate transfer member 10 to transfer the image on the intermediate transfer member 10 onto a sheet.

Next to the secondary transferring unit 22, fixing unit which is configured to fix a transferred image on a sheet is arranged. The fixing unit is constituted such that pressurizing roller 27 is pressed against fixing belt 26 which is formed in an endless belt.

The secondary transferring unit 22 is also capable of transporting a sheet after image transfer to the fixing unit 25. Naturally, a transfer roller or a non-contact charger can be used as the secondary transferring unit 22. In this case, it is difficult that the secondary transferring unit 22 has the capability of transporting the sheet.

The apparatus shown in FIG. 5 also includes a sheet reverser 28 below the secondary transferring unit 22 and the fixing unit 25 in parallel with the tandem image forming apparatus 20. The sheet reverser 28 is capable of reversing the sheet so as to form images on both sides of the sheet.

A copy is made using the color electrophotographic apparatus in the following manner. Initially, a document is placed on a document platen 30 of the automatic document feeder 400. Alternatively, the automatic document feeder 400 is opened, the document is placed on a contact glass 32 of the scanner 300, and the automatic document feeder 400 is closed to press the document.

When pressing on a start switch (not shown), the document, if any, placed on the automatic document feeder 400 is transported onto the contact glass 32. When the document is initially placed on the contact glass 32, the scanner 300 is immediately driven to operate first carriage 33 and second carriage 34. Light is applied from a light source to the document, and reflected light from the document is further reflected toward the second carriage 34 at the first carriage 33. The reflected light is further reflected by a mirror of the second carriage 34 and passes through image-forming lens 35 into a read sensor 36 to thereby read the document.

When pressing on the start switch (not shown), a drive motor (not shown) rotates and drives one of the support rollers 14, 15 and 16 to thereby allow the residual two support rollers to rotate following the rotation of the one support roller to thereby rotatably convey the intermediate transfer member 10. Simultaneously, the individual image forming units 18 respectively rotate their photoconductors 40 to thereby form black, yellow, magenta, and cyan monochrome images on the photoconductors 40, respectively. With the conveying intermediate transfer member 10, the monochrome images are sequentially transferred to form a composite color image on the intermediate transfer 10.

Separately, when pressing on the start switch (not shown), one of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copier main body 100 and are bumped against a resist roller 49.

Alternatively, pressing on the start switch rotates a feeder roller 50 to eject sheets on a manual bypass tray 51, the sheets are separated one by one on a separation roller 52 into a manual bypass feeder path 53 and are bumped against the resist roller 49.

The resist roller 49 is rotated synchronously with the movement of the composite color image on the intermediate transfer member 10 to transport the sheet into between the intermediate transfer member 10 and the secondary transferring unit 22, and the composite color image is transferred onto the sheet by action of the secondary transferring unit 22 to thereby record a color image.

The sheet bearing the transferred image is transported by the secondary transferring unit 22 into the fixing unit 25, is applied with heat and pressure in the fixing unit 25 to fix the transferred image, changes its direction by action of switch blade 55, is ejected by an ejecting roller 56 and is stacked on output tray 57. Alternatively, the sheet changes its direction by action of the switch blade 55 into the sheet reverser 28, turns therein, is transported again to the transfer position, followed by image formation on the back surface of the sheet. The sheet bearing images on both sides thereof is ejected through the ejecting roller 56 onto the output tray 57.

Separately, the intermediate transfer cleaning unit 17 removes a residual toner on the intermediate transfer member 10 after image transfer for another image forming procedure by the tandem image forming apparatus 20.

Herein, the resist roller 49 is typically grounded, however, it is also acceptable to apply a bias thereto for the removal of paper dust of sheet.

Figure 6:
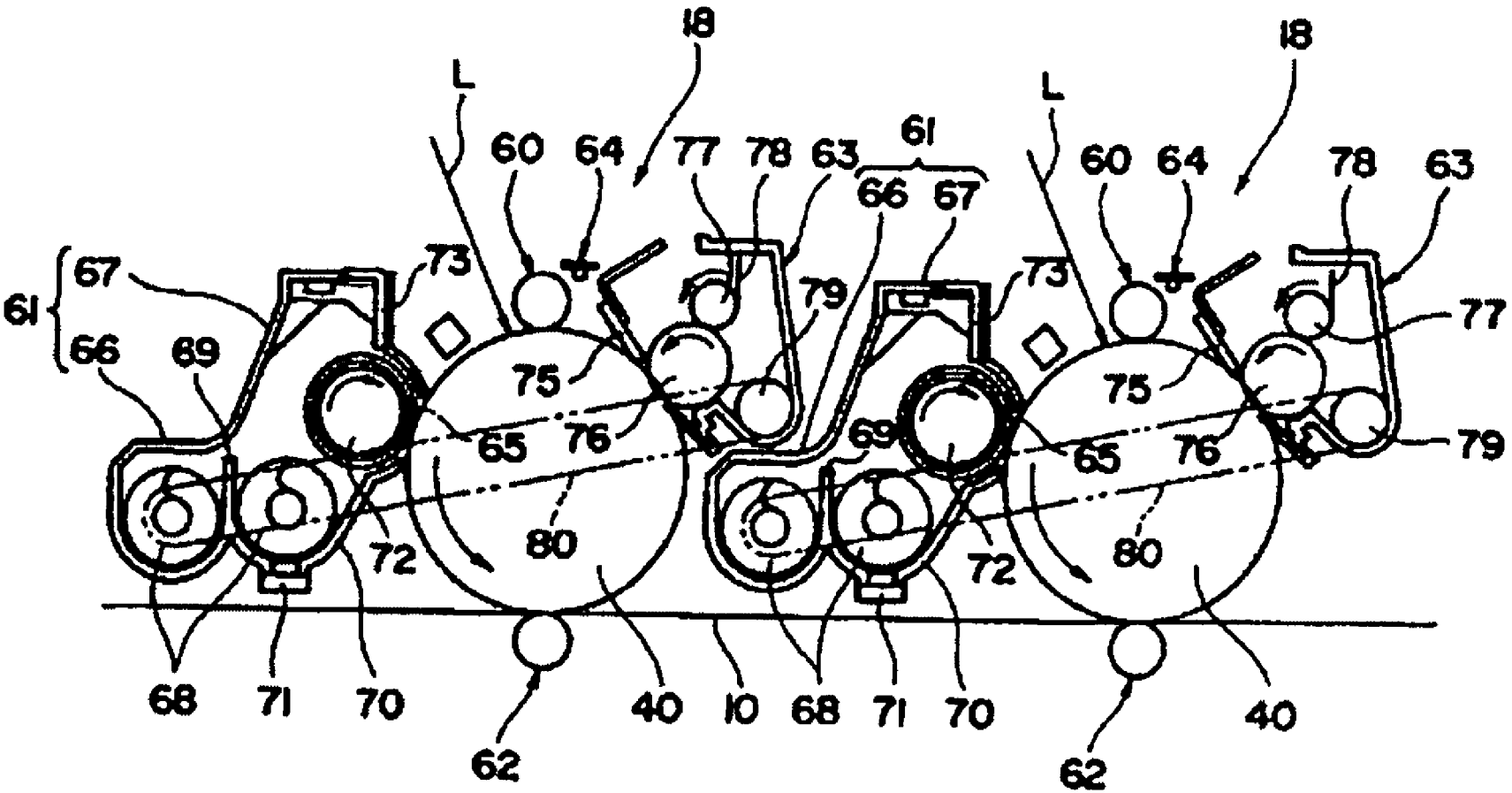
FIG. 6 is a schematic block diagram showing an example of the image forming unit according to an embodiment of the present invention.

In the tandem image forming apparatus as described above, each of the individual image forming units 18, for example, as shown in FIG. 6, specifically is provided with charging unit 60, developing unit 61, primary transferring unit 62, photoconductor cleaning unit 63, and charge eliminating unit 64 around drum-shaped photoconductor 40.

(Process Cartridge)

Figure 7:
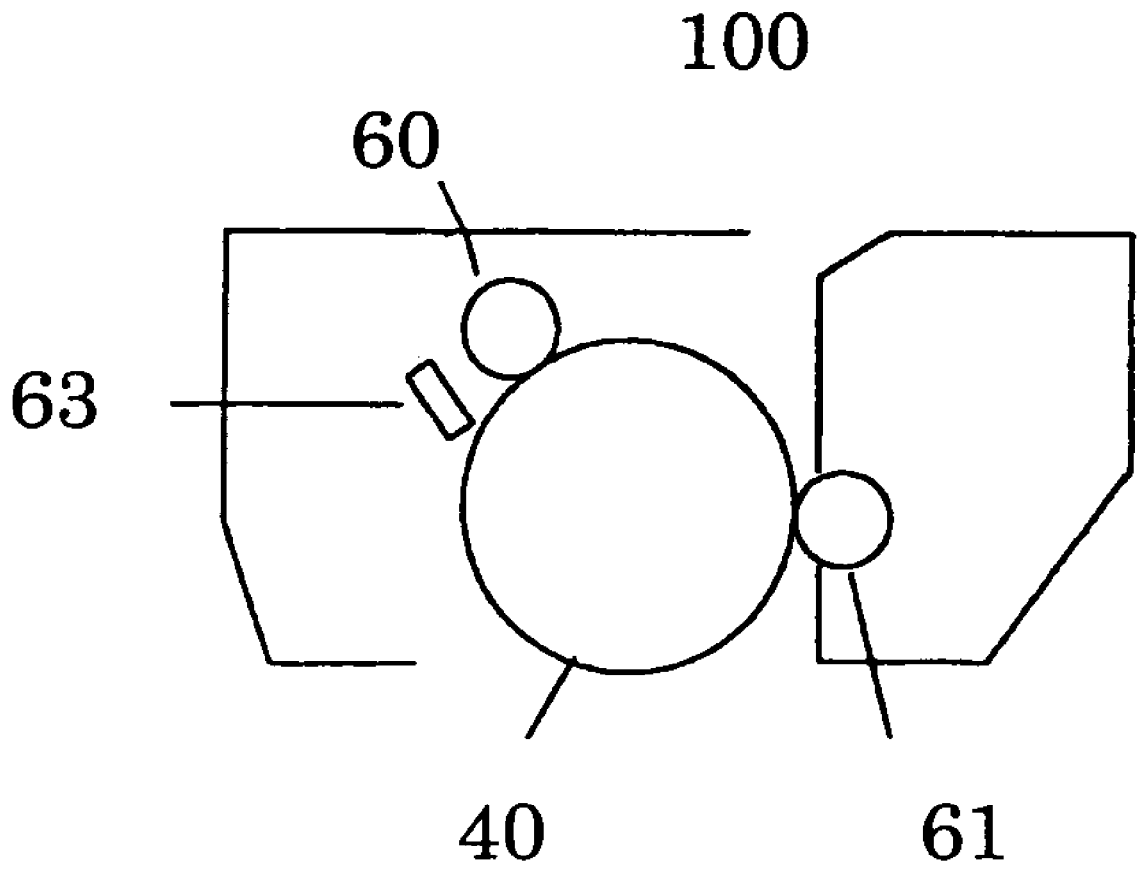
FIG. 7 is a schematic block diagram showing an example of the process cartridge according to an embodiment of the present invention.

FIG. 7 is a schematic illustration showing an example of the process cartridge of the present invention. Process cartridge for electrophotographic apparatuses 100 is provided with photoconductor drum 40 serving as the photoconductor, charge roller 60 serving as the charge unit, photoconductor cleaning unit 63 serving as the cleaning unit, and developing unit 61 serving as the developing unit all of which are detachably mounted to the printer main body so as to integrally constitute a process cartridge.

EXAMPLES

Hereinafter, the present invention will be described in detail referring to specific examples, however, the present invention is not limited to the disclosed examples. It should be noted that the units represented by "part", "parts", and "%" below are construed on the basis of "weight", namely, as "part by weight", "parts by weight", or "% by weight", unless otherwise noted.

(Evaluation of Two-Component Developer)

When images formed with a two-component developer were evaluated, as shown below, a ferrite carrier having an average particle diameter of 35 μm coated with a silicone resin having an average thickness of 0.5 μm was used, and 7 parts by weight of each of color toners were used relative to 100 parts by weight of the carrier, and the carrier and the each of color toners were uniformly mixed using a tabular mixer of which a container was rolling such that the contents therein could be stirred to charge the color toners and to thereby prepare a developer.

(Preparation of Carrier)

Core Material

| | |
|---|---|
| Mn ferrite particles (weight average particle diameter: 35 μm) | 5,000 parts |

Coat Material

| | |
|---|---|
| Toluene | 450 parts |
| Silicone resin SR2400 (manufactured by TORAY DOW CORNING CO., LTD.; nonvolatile part 50%) | 450 parts |
| Aminosilane SH6020 (manufactured by TORAY DOW CORNING CO., LTD.) | 10 parts |
| Carbon black | 10 parts |

The coat materials stated above were dispersed with a stirrer for 10 minutes to prepare a coating solution. The coating solution and the core material were poured into a coater equipped with a rotatable bottom plate and stirring fans within a fluidized bed while forming a swirling flow to coat the coating solution on the core material, and then the coated material was calcined at 250° C. for 2 hours using an electric furnace to thereby obtain the carrier.

Example 1

-Synthesis of Organic Fine Particle Emulsion-

Production Example 1

To a reaction vessel equipped with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 166 parts of methacrylic acid, 110 parts of butyl acrylate, and 1 part of ammonium persulphate were poured, and stirred at 3,800 rpm for 30 minutes to obtain a white emulsion. The white emulsion was heated, the temperature in the system was raised to 75° C., and the reaction was performed for 4 hours. Next, 30 parts of an aqueous solution of 1% ammonium persulphate was further added, and the reaction mixture was matured at 75° C. for 6 hours to obtain an aqueous dispersion liquid of a vinyl resin (copolymer of methacrylic acid-butyl acrylate-sodium salt of the sulfuric acid ester of methacrylic acid ethylene oxide adduct) [particulate emulsion 1]. The volume average particle diameter of the [particulate emulsion 1] measured by means of LA-920 was 110 nm. After drying a part of [particulate emulsion 1] and isolating the resin, the glass transition temperature (Tg) of the resin was 58° C. and the weight average molecular weight was 130,000.

-Preparation of Aqueous Phase-

Production Example 2

To 990 parts of water, 83 parts of [particulate emulsion 1], 37 parts of a 48.3% aqueous solution of sodium dodecyl diphenylether disulfonic acid (ELEMINOL MON-7, manufactured by Sanyo Chemical Industries, Ltd.) and 90 parts of ethyl acetate were mixed and stirred together to obtain a milky liquid. This was taken as [aqueous phase 1].

-Synthesis of Low-Molecular Polyester-

Production Example 3

In a reaction vessel equipped with a condenser tube, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were poured, and the reaction was performed under normal pressure at 230° C. for 7 hours, and the reaction was further performed under a reduced pressure of 10 mmHg to 15 mmHg for 5 hours, then 44 parts of anhydrous trimellitic acid was added to the reaction vessel, and the reaction was performed at 180° C. under normal pressure for 3 hours to obtain [low molecular weight polyester 1]. [Low molecular weight polyester 1] had a number average molecular weight of 2,300, a weight average molecular weight of 6,700, a glass transition temperature (Tg) of 43° C. and an acid value of 25.

-Synthesis of Intermediate Polyester-

Production Example 4

In a reaction vessel equipped with a condenser tube, a stirrer, and a nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid and 2 parts of dibutyl tin oxide were poured, and the reaction was performed under normal pressure at 230° C. for 7 hours, and then the reaction was further performed under a reduced pressure of 10 mmHg to 15 mmHg for 5 hours to obtain [intermediate polyester 1]. [Intermediate polyester 1] had a number average molecular weight of 2,200, a weight average molecular weight of 9,700, a glass transition temperature (Tg) of 54° C., an acid value of 0.5, and a hydroxyl value of 52

Next, in a reaction vessel equipped with a condenser, a stirrer, and a nitrogen inlet tube, 410 parts of the [intermediate polyester 1], 89 parts of isophorondiisocyanate, and 500 parts of ethyl acetate were poured, and the reaction was performed at 100° C. for 5 hours to obtain [prepolymer 1]. [Prepolymer 1] had a free isocyanate content of 1.53% by weight.

-Synthesis of Ketimine-

Production Example 5

Into a reaction vessel equipped with a stirrer and a thermometer, 170 parts of isophorone diamine and 75 parts of methyl ethyl ketone were poured, and the reaction was performed at 50° C. for 4.5 hours to obtain [ketimine compound 1]. The amine value of [ketimine compound 1] was 417.

-Synthesis of Masterbatch (MB)-

Production Example 6

To 1,200 parts of water, 540 parts of carbon black (Printex35, manufactured by Degsa Co.)[DBP oil absorption=42 ml/100 mg, pH=9.5], and 1,100 parts of polyester resin were added and mixed in HENSCHEL MIXER (manufactured by MITSUI MINING CO., LTD.), then the mixture was kneaded at 130° C. for 1 hour using two rollers, extrusion cooled and crushed with a pulverizer to obtain [masterbatch 1].

-Preparation of Oil Phase-

Production Example 7

Into a vessel equipped with a stirrer and a thermometer, 378 parts of the [low molecular weight polyester 1], 100 parts of carnauba wax, and 947 parts of ethyl acetate were poured, and the temperature was raised to 80° C. with stirring, maintained at 80° C. for 5 hours and cooled to 30° C. in 1 hour. Next, 500 parts of [masterbatch 1] and 500 parts of ethyl acetate were poured into the vessel, and mixed for 1 hour to obtain [initial material solution 1].

To a vessel, 1,324 parts of [initial material solution 1] were transferred, and the carbon black and the wax were dispersed three times using BEAD MILL (Ultra Visco Mill, manufactured by AIMEX CO., LTD.) under the conditions of liquid feed rate of 1 kg/hr, disc circumferential speed of 6 m/s, and 0.5 mm zirconia beads packed to 80% by volume.

Next, 1,324 parts of a 65% ethyl acetate solution of [low molecular weight polyester 1] were added to the vessel and dispersed twice using BEAD MILL under the above-noted conditions to obtain [pigment-wax dispersion 1]. The solids concentration of [pigment-wax dispersion 1] (130° C. for 30 minutes) was 50%.

-Emulsification and Removal of Solvent-

Production Example 8

In a vessel, 749 parts of [pigment-wax dispersion 1], 115 parts of [prepolymer 1], and 2.9 parts of [ketimine compound 1] were poured and mixed at 5,000 rpm for 2 minutes using a TK homomixer (manufactured by TOKUSHU KIKA KOGYO CO., LTD.), then 1,200 parts of [aqueous phase 1] were added to the vessel and mixed in the TK homomixer at a rotation speed of 13,000 rpm for 25 minutes to obtain [emulsion slurry 1].

To a vessel equipped with a stirrer and a thermometer, the [emulsion slurry 1] was poured, the [emulsion slurry 1] was subjected to a solvent removal treatment at 30° C. for 8 hours and then matured at 45° C. for 7 hours to thereby obtain [dispersion slurry 1].

-Washing and Drying-

Production Example 9

After filtering 100 parts of [dispersion slurry 1] under reduced pressure, the following treatments were carried out:

a) 100 parts of ion exchange water were added to the filter cake and mixed in a TK homomixer (rotation speed 12,000 rpm for 10 minutes) and filtered.
b) 100 parts of a 10% sodium hydroxide solution were added to the filter cake of a) and mixed in the TK homomixer (rotation speed 12,000 rpm for 30 minutes) and filtered under reduced pressure.
c) 100 parts of a 10% hydrochloric acid were added to the filter cake of b) and mixed in the TK homomixer (rotation speed 12,000 rpm for 10 minutes) and filtered.
d) 300 parts of ion exchange water were added to the filter cake of c) and mixed in the TK homomixer (rotation speed 12,000 rpm for 10 minutes), and filtered twice to thereby obtain [filter cake 1].

[Filter cake 1] was dried in a circulating air dryer at 45° C. for 48 hours.

In a water solvent tank of which a fluoride compound (2) was dispersed at a concentration of 1% by weight, the [filter cake 1] was added to the water solvent and mixed such that the content of the fluoride compound (2) was 0.09% by weight relative to the toner base particles, to make the fluoride compound (2) adhere on or bound to the toner surface, and the mixture was dried in a circulating air dryer at 45° C. for 48 hours. Then the dried mixture was sieved through a sieve of 75 μm mesh to thereby obtain [toner base particles 1].

Thereafter, 100 parts of the [toner base particles 1] and 1 part of hydrophobized silica were mixed in HENSCHEL MIXER to thereby obtain a toner. Table 1 shows the physical properties of the obtained toner, and Table 2 shows the evaluation results of the toner.

Example 2

A toner is produced in the same manner as in Example 1 except that a fluoride compound (1) was used instead of the fluoride compound (2). Table 1 shows the physical properties of the obtained toner, and Table 2 shows the evaluation results of the toner.

Example 3

A toner was produced in the same manner as in Example 1 except that methanol was added to the water solvent tank and mixed such that the content of the methanol was 30% by weight, and then the fluoride compound was made to adhere on the toner surface. Table 1 shows the physical properties of the obtained toner, and Table 2 shows the evaluation results of the toner.

Example 4

<First Step>

--Preparation of Dispersion (1)--

| | |
|---|---|
| Styrene | 370 g |
| n butyl acrylate | 30 g |
| Acrylic acid | 8 g |
| Dedecanethiol | 24 g |
| Carbon tetrabromide | 4 g |

In a flask, a dispersion with the components stated above mixed and dissolved each other was dispersed to a solution in which 6 g of nonionic surfactant (Nonipol 400, manufactured by Sanyo Chemical Industries, Ltd.), and 10 g of anionic surfactant (Neogen SC, manufactured by Daiichi Kogyo Seiyaku Co., Ltd.) were dissolved in 550 g of ion exchange water, the dispersion was emulsified, and then 50 g of ion exchange water with 4 g of ammonium persulfate added thereto was poured to the dispersion while slowly mixing the dispersion for 10 minutes. The contents in the flask was subjected to a nitrogen substitution process and then heated in an oil bath while stirring the contents in the flask until the temperature of the contents was 70° C., and the emulsion polymerization was continued in the same condition for 5 hours. Consequently, dispersion (1) with resin particles having an average particle diameter of 155 nm, a glass transition temperature of 59° C., and a weight average molecular weight (Mw) of 12,000 dispersed therein was prepared.

--Preparation of Dispersion (2)--

| | |
|---|---|
| Styrene | 280 g |
| n butyl acrylate | 120 g |
| Acrylic acid | 8 g |

In a flask, a dispersion with the components stated above mixed and dissolved each other was dispersed to a solution in which 6 g of nonionic surfactant (Nonipol 400, manufactured by Sanyo Chemical Industries, Ltd.), and 12 g of anionic surfactant (Neogen SC, manufactured by Daiichi Kogyo Seiyaku Co., Ltd.) were dissolved in 550 g of ion exchange water, the dispersion was emulsified, and then 50 g of ion exchange water with 3 g of ammonium persulfate added thereto was poured to the dispersion while slowly mixing the dispersion for 10 minutes. The contents in the flask was subjected to a nitrogen substitution process and then heated in an oil bath while stirring the contents in the flask until the temperature of the contents was 70° C., and the emulsion polymerization was continued in the same condition for 5 hours. Consequently, dispersion (2) with resin particles having an average particle diameter of 105 nm, a glass transition temperature of 53° C., and a weight average molecular weight (Mw) of 550,000 dispersed therein was prepared.

--Preparation of Colorant Dispersion (1)--

| | |
|---|---|
| Carbon black (Mogal L; manufactured by Cabot Corp.) | 50 g |
| Nonionic surfactant (Nonipol 400; manufactured by Sanyo Chemical Industries, Ltd.) | 5 g |
| Ion exchange water | 200 g |

The components stated above were mixed, dissolved, and dispersed for 10 minutes using a homogenizer (Ultratalax T50, manufactured by IKA-WERKE GMBH & Co., KG) to thereby prepare colorant dispersion (1) with a colorant (carbon black) having an average particle diameter of 250 nm dispersed therein.

--Preparation of Releasing Agent Dispersion (1)--

| | |
|---|---|
| Paraffin wax (HNP0190 (melting point: 85° C.; manufactured by NIPPON SEIRO CO., LTD.) | 50 g |
| Cationic surfactant (Sanizol B50; manufactured by KAO CORPORATION) | 5 g |
| Ion exchange water | 200 g |

The components stated above were heated and dispersed using a homogenizer (Ultratalax T50, manufactured by IKA-WERKE GMBH & Co., KG) and then further dispersed using a pressure ejection type homogenizer to thereby prepare releasing agent dispersion (1) with a releasing agent having an average particle diameter of 550 nm dispersed therein.

--Preparation of Flocculated Particles--

| | |
|---|---|
| Dispersion (1) | 120 g |
| Dispersion (2) | 80 g |
| Colorant dispersion (1) | 30 g |
| Releasing agent dispersion (2) | 40 g |
| Cationic surfactant | 1.5 g |

(Sanizol B50; Manufactured by KAO CORPORATION)

In a round stainless steel flask, the components stated above were mixed and dispersed each other using a homogenizer (Ultratalax T50, manufactured by IKA-WERKE GMBH & Co., KG) and then the contents in the flask were heated in a heating oil bath while stirring the contents in the heating oil bath until the temperature of the contents was 48° C. The contents were maintained at 48° C. for 30 minutes, and then the contents were observed using an optical microscope. As a result of the observation, it was ascertained that flocculated particles having an average particle diameter of around 5 μm (volume: 95 $cm^3$) had been formed.

<Second Step>

--Preparation of Adhesion Particles--

To the stainless steel flask, 60 g of the dispersion (1) being a resin-containing fine particle dispersion was slowly added. The volume of the resin particles contained in the dispersion (1) was 25 $cm^3$. The temperature of the heating oil bath was raised to 50° C. and, the temperature was maintained for 1 hour.

<Third Step>

Then, to the stainless steel flask, 3 g of anionic surfactant (Neogen SC, manufactured by Daiichi Kogyo Seiyaku Co., Ltd.) was added, and the stainless steel flask was sealed. The contents of the flask were heated to 105° C. while continuously stirring the contents with a magneto-seal, and the temperature was maintained for 3 hours. Then, after cooling the contents, the reactant product was filtered, adequately washed, and then dried.

<Fourth Step>

Next, the reactant product was subjected to a surface treatment in a water bath such that the fluoride compound (2) was made to adhere on the toner surface with the content of the fluoride compound (2) being 0.09% by weight relative to the toner base particles. Then, the reactant product was dried in a circulating air drier at 45° C. for 48 hours. The dried product was sieved through a sieve of 75 μm mesh to thereby obtain toner base particles.

<Fifth Step>

Then, 100 parts of the toner base particles and 1 part of hydrophobized silica were mixed in HENSCHEL MIXER to obtain a toner. Table 1 shows the physical properties of the obtained toner, and Table 2 shows the evaluation results of the toner.

Example 5

In a reaction vessel equipped with a condenser tube, a stirrer, and a nitrogen inlet tube, 724 parts of bisphenol A ethylene oxide dimolar adduct, 276 parts of isophthalic acid, and 2 parts of dibutyl tin oxide were poured, the reaction was performed under normal pressure at 230° C. for 8 hours, and then the reaction was further performed under a reduced pressure of 10 mmHg to 15 mmHg for 5 hours, and the reactant was cooled down to 160° C. Then, 32 parts of phthalic acid anhydride were added to the reactant, and the reaction was performed for 2 hours. Next, the reactant was cooled down to 80° and then reacted with 188 parts of isophorondiisocyanate in ethyl acetate for 2 hours to thereby obtain isocyanate-containing prepolymer (1).

Next, 267 parts of the isocyanate-containing prepolymer (1) was reacted with 14 parts of isophorone diamine at 50° C. for 2 hours to thereby obtain urea-modified polyester (1) having a weight average molecular weight of 64,000. Similarly to the above, 724 parts of bisphenol A ethylene oxide dimolar adduct, 138 parts of terephthalic acid, and 138 parts of isophthalic acid were polycondensed at 230° C. for 6 hours, and the reaction was performed under reduced pressure of 10 mmHg to 15 mmHg for 5 hours to thereby obtain unmodified polyester (a) having a peak molecular weight of 2,300, a hydroxyl value of 55, and an acid value of 1.

To 1,000 parts of an ethyl acetate/MEK (1:1) mixed solvent, 200 parts of the urea-modified polyester (1) and 800 parts of the unmodified polyester (a) were dissolved and mixed to obtain an ethyl acetate/MEK solution of toner binder (1).

To a reaction vessel equipped with a condenser tube, a stirrer, and a thermometer, 942 parts of water, 58 parts of a 10% hydroxy apatite suspension (Supertite 10, manufactured by Nippon Chemical Industrial CO., LTD.) were poured, and 1,000 parts of the ethyl acetate/MEK solution of toner binder (1) were added to the reaction vessel and dispersed with stirring. The temperature of the dispersion was raised to 98° C. to remove the organic solvent, and the dispersion was cooled and filtered to be separated from water, washed, and dried to thereby obtain toner binder (1)

of the present invention. The toner binder (1) had a Tg of 52° C., a Tη of 123° C., and a Tg' of 132° C.

A toner was prepared using 100 parts of the toner binder (1), 7 parts of glycerine tribehenate, and 4 parts of cyanine blue KRO (manufactured by Sanyo Color Works, LTD.) in accordance with the following method. First, the components stated above were preliminarily mixed using a Henschel mixer (FM10B, manufactured by Mitsui Miike Kakoki K.K.) and then kneaded with a two-axis kneader (PCM-30, manufactured by IKEGAI LTD.). Next, the kneaded components were finely pulverized using a supersonic jet pulverizer labo-jet (manufactured by Nippon Pneumatic Manufacturing Co., Ltd) and then classified in a airflow classifier (MDS-I, manufactured by Nippon Pneumatic Manufacturing Co., Ltd). Then, in the water solvent tank in which the fluoride compound (2) had been dispersed, the fluoride compound (2) was made to adhere on the toner surface, and the product was dried in a circulating air drier at 45° C. for 48 hours. Then, the product was sieved through a sieve of 75 μm mesh to thereby obtain toner base particles. Thereafter, 100 parts of the toner base particles and 1 part of hydrophobized silica were mixed in HENSCHEL MIXER to obtain a toner. Table 1 shows the physical properties of the obtained toner, and Table 2 shows the evaluation results of the toner.

Example 6

(Polyol Resin 1)

To a separable flask equipped with a stirrer, a thermometer, a $N_2$ inlet tube, and a condenser tube, 378.4 g of low-molecule bisphenol A epoxy resin (number average molecular weight: around 360), 86.0 g of high-molecule bisphenol A epoxy resin (number average molecular weight: around 2,700), 191.0 g of a diglycidyl compound of bisphenol A propylene oxide adduct [in General Expression (1), n+m: approx. 2.1], 274.5 g of bisphenol F, 70.1 g of p-cumylphenol, and 200 g of xylene were added.

The temperature of the contents was raised to 70° C. to 100° C. in a $N_2$ atmosphere, 0.183 g of lithium chloride was added to the contents, and the temperature of the contents was further raised to 160° C., and water was added to the contents under reduced pressure to make water and xylene bubbled to thereby remove water, xylene, other voltaic components, and polar solvent soluble components from the contents in the flask. The contents in the flask were polymerized at a reaction temperature of 180° C. for 6 hours to 9 hours to thereby obtain 1,000 g of a polyol resin having a Mn of 3,800, a Mw/Mn of 3.9, a Mp of 5,000, a softening point of 109° C., a Tg of 58° C., and an epoxy equivalent ratio of 20,000 or more (polyol resin 1). In the polymerization reaction, the reaction conditions were controlled such that monomer components remained in the contents. The polyoxy alkylene parts having main chains were determined by means of NMR spectrometer.

(Production of Toner)

| | |
|---|---|
| Water | 1,000 parts |
| Phthalocyanine green-containing water cake (solids concentration of 30%) | 200 parts |
| Carbon black (MA 60, manufactured by Mitsubishi Chemical Corporation) | 540 parts |
| Polyol resin 1 | 1,200 parts |

The initial materials stated above were mixed in HENSCHEL MIXER to obtain a mixture into which water was infiltrated. The mixture was kneaded using two rollers with the roller surface temperature set at 110° C. for 30 minutes, extrusion cooled and crushed with a pulverizer to thereby obtain a masterbatch pigment.

| | |
|---|---|
| Polyol resin 1 | 100 parts |
| The above noted masterbatch | 8 parts |
| Charge controlling agent (Bontron E-84, manufactured by Orient Chemical Industries, Ltd.) | 1.5 parts |
| Wax (fatty acid ester wax, melting point: 83° C., viscosity: 280 mPa · s (90° C.)) | 5 parts |

The materials stated above were mixed in a mixer, fused and kneaded twice using a two-roller mill to make the kneaded materials extrusion cooled. Then, the extrusion cooled materials were pulverized with a collision plate type jet mill pulverizer (I-type mill, manufactured by Nippon Pneumatic Manufacturing Co., Ltd.) and then classified using a swirling flow wind-driven classifier (DS classifier, manufactured by Nippon Pneumatic Manufacturing Co., Ltd.) to thereby obtain black-colored particles. Then, 100 parts of the colored particles, 0.5 parts of fluoride compound (2) were mixed in a Q mixer to make the fluoride compound (2) fixed on surfaces of the toner base particles. The toner was sieved through a sieve of 75 μm mesh to obtain toner base particles. Then, 100 parts of the toner base particles, and 1 part of hydrophobized silica were mixed in HENSCHEL MIXER to thereby obtain a toner. Table 1 shows the physical properties of the obtained toner, and Table 2 shows the evaluation results of the toner.

Comparative Example 1

A toner was produced in the same manner as in Example 1 except that the surface treatment with the fluoride compound (2) was omitted in the washing and drying step. The toner was evaluated. Table 1 shows the physical properties of the obtained toner, and Table 2 shows the evaluation results of the toner.

Comparative Example 2

A toner was produced in the same manner as in Example 1, except that the amount of the fluoride compound used relative to the toner base particles was changed to 0.02% by weight. The toner was evaluated. Table 1 shows the physical properties of the obtained toner, and Table 2 shows the evaluation results of the toner.

Comparative Example 3

A toner was produced in the same manner as in Example 1 except that the amount of the fluoride compound used relative to the toner base particles was changed to 0.3% by weight. The toner was evaluated. Table 1 shows the physical properties of the obtained toner, and Table 2 shows the evaluation results of the toner.

(Evaluation Items)

1) Particle Diameter

The particle diameter of each of the toners was measured by means of a particle sizer with an aperture diameter of 100 μm, Coulter Counter TAII manufactured by Coulter Electronics Ltd. The volume average particle diameter and the number average particle diameter of each of the toners were respectively determined by means of the particle sizer.

2) Average Circularity E

The average circularity E of each of the toners can be measured by means of a flow particle image analyzer FPIA-1000 (manufactured by SYSMEX Corp.). Specifically, in a vessel, to 120 ml of water in which impure solids were preliminarily removed, a surfactant as a dispersing agent, preferably, 0.3 ml of alkylbenzenesulfonate was added, and further around 0.2 g of the measurement sample was added. The suspension with the sample dispersed therein was dispersed for approx. 2 minutes by means of an ultrasonic dispersion apparatus so that the concentration of the dispersion liquid was approx. 5,000 pieces/μL. The average circularity of toner was obtained by measuring the toner shape and the toner particle distribution through the use of the flow particle image analyzer.

3) Circularity SF-1 and SF-2

Scanning electron microscopic mages of the obtained each of toners were taken through the use of FE-SEM (field emission scanning electron microscope S-4200, manufactured by Hitachi, Ltd.). Among the images, 300 images were sampled at random, and the image information was introduced to an image analyzer (Luzex Ap, manufactured by NIRECO Corporation) through an interface to thereby analyze and determine the circularity SF-1 and SF2.

4) Fixing Property

A printer, imagio Neo 450, manufactured by Ricoh Co., Ltd. was remodeled so as to be based on belt-fixing method. A solid image was output on transferring sheets of regular paper and heavy paper (duplicator printing paper 6200 and NBS <135>, respectively manufactured by Ricoh Co., Ltd.) with a toner adhesion amount of 1.0 mg/cm$^2$±0.1 mg/cm$^2$. The each of the toners were evaluated with respect to fixing property. The fixing test was performed with varying the temperature of the fixing belt, and the upper limit temperature at which no hot-offset had occurred was taken as the upper limit fixing temperature. The lower limit fixing temperature was measured using heavy paper. A fixing roll temperature at which the residual ratio of the image density after patting the surface of the obtained fixed image with a pat had been 70% or more was taken as the lower limit fixing temperature. The upper limit fixing temperature is desired to be 190° C. or more, and the lower limit fixing temperature is desired to be 140° C. or less.

5) Cleaning Ability

After outputting 100 sheets, a residual toner after transfer remaining on the photoconductor which had gone through a cleaning step was transferred to a white paper sheet using a scotch tape (manufactured by Sumitomo 3M Limited) to measure the reflection density by a reflection densitometer (Macbeth reflection densitometer RD514). A toner which had a difference in reflection density from that of the blank portion of the paper being less than 0.005 was evaluated as A, a toner which had a difference thereof being 0.005 to 0.010 was evaluated as B, a toner which had a difference thereof being 0.011 to 0.02 was evaluated as C, and a toner which had a difference thereof being more than 0.02 was evaluated as D.

6) Charge Stability

An evaluation system, IPSiO Color 8100 manufactured by Ricoh Co., Ltd., which had been remodeled and tuned so as to be based on oil-less fixing method, was used for the evaluation on charge stability of each of the toners. Using each of the obtained toners, 10,000 sheets of a 5% image-area ratio chart were consecutively output to perform an output durability test. The change in charged amount at that time was evaluated. Specifically, 1 g of the developer was weighed, and the change in charged amount was determined by blow-off method. A toner which had a change in charged amount being 5 μc/g or less was evaluated as A; a toner which had a change in charged amount being 10 μc/g or less was evaluated as B; and a toner which had a change in charged amount being more than 10 μc/g was evaluated as C.

7) Image Density

A copier, imagio Neo 450 manufactured by Ricoh Co., Ltd. was remodeled so as to be belt fixing method. After outputting a solid image on transferring sheets of regular paper (duplicator printing paper 6200, manufactured by Ricoh Co., Ltd.) with a toner adhesion amount of 0.4 mg/cm$^2$±0.1 mg/cm$^2$, the image density was evaluated by means of X-Rite (manufactured by X-Rite Inc.). A toner which had an image density of 1.4 or more was evaluated as A, and a toner which had an image density less than 1.4 was evaluated as B.

8) Image Granularity and Image Sharpness

Using IPSiO Color 8100 manufactured by Ricoh Co., Ltd., which had been remodeled and tuned so as to be based on oil-less fixing method, a photographic image was output in monochrome, and the image granularity degree and the image sharpness degree of each of the obtained toners were visually checked and evaluated. The results of image granularity and image sharpness of obtained toners were ranked in order of excellence as A, B, C, and D. A toner ranked as A had an image granularity degree and an image sharpness degree being equivalent to those obtained in offset printing; a toner ranked as B had an image granularity degree and an image sharpness degree being slightly poorer than those obtained in offset printing; a toner ranked as C had an image granularity degree and an image sharpness degree being substantially poorer than those obtained in offset printing; and a toner ranked as D had an image granularity degree and an image sharpness degree being equivalent to those of images obtained in conventional electrophotography, and the results are fairly poor.

9) Ground Fogging

Using IPSiO Color 8100 manufactured by Ricoh Co., Ltd., which had been remodeled and tuned so as to be based on oil-less fixing method under conditions of a temperature of 10° C. and a humidity of 15%, and using each of the obtained toners, 10,000 sheets of a 5% image-area ratio chart were consecutively output to perform an output durability test. The degrees of toner fogging at the grounds of the transferring sheets after completion of the output durability test were visually checked using a magnifier and evaluated. The results of ground fogging of obtained toners were ranked in order of excellence as A, B, C, and D. A toner ranked as A was in an excellent condition where no toner smear was observed; a toner ranked as B was in a condition where a trace amount of toner fogging was observed, and there was not problematic; a toner ranked as C was in a condition where a small amount of toner fogging was observed; and a toner ranked as D was beyond the bounds of permissibility and caused a substantial amount of toner fogging, which could be problematic.

10) Toner Scattering

Using IPSiO Color 8100 manufactured by Ricoh Co., Ltd., which had been remodeled and tuned so as to be based on oil-less fixing method under conditions of a temperature of 40° C. and a humidity of 90%, and using each of the obtained toners, 10,000 sheets of a 5% image-area ratio chart were consecutively output to perform an output durability test. The toner contamination appearance in the copier after completion of the output durability test was visually checked and evaluated. A toner ranked as A was in an excellent condition where no toner scattering was observed; a toner ranked as B was in a condition where a trace amount of toner scattering was observed, and there was not problematic; a toner ranked as C was in a condition where a small amount of toner scattering was observed; and a toner ranked as D was beyond the bounds of permissibility and caused a substantial amount of toner scattering, which could be problematic.

11) Environment—Storage Stability

In a 20 mL glass bottle, each of the obtained toners weighed in an amount of 10 g was put. After tapping the glass bottle 100 times, the glass bottle was left in a thermostatic batch with a temperature and a humidity set to 55° C. and 80%, respectively, for 24 hours, and then the each of the obtained toners were measured with respect to rate of penetration by means of a penetrometer. In addition, similarly, each of toners stored in low-temperature and low-humidity conditions (10° C. and 15%) were also evaluated with respect to rate of penetration. The smaller rate of penetration of each of the toners in high-temperature and high-humidity conditions and low-temperature and low-humidity conditions was employed for evaluation. A toner ranked as A had a rate of penetration being 20 mm or more; a toner ranked as B had a rate of penetration being 15 mm or more to less than 20 mm; a toner ranked as C had a rate of penetration being 10 mm or more to less than 15 mm; and a toner ranked as D had a rate of penetration being less than 10 mm.

TABLE 1

| | Circularity | | | Particle Diameter | | |
|---|---|---|---|---|---|---|
| | Average circularity E | Circularity SF1 | Circularity SF2 | Volume average particle diameter (Dv) | Number average particle diameter (Dn) | Dv/Dn |
| Ex. 1 | 0.96 | 120 | 115 | 5.6 | 5.1 | 1.10 |
| Ex. 2 | 0.96 | 120 | 115 | 5.6 | 5.1 | 1.10 |
| Ex. 3 | 0.96 | 120 | 115 | 5.6 | 5.1 | 1.10 |
| Ex. 4 | 0.96 | 120 | 115 | 5.6 | 5.1 | 1.10 |
| Ex. 5 | 0.89 | 115 | 128 | 6.9 | 5.7 | 1.21 |
| Ex. 6 | 0.86 | 149 | 141 | 7.1 | 5.6 | 1.27 |
| Compara. Ex. 1 | 0.96 | 120 | 115 | 5.6 | 5.1 | 1.10 |
| Compara. Ex. 2 | 0.96 | 120 | 115 | 5.6 | 5.1 | 1.10 |
| Compara. Ex. 3 | 0.97 | 121 | 117 | 5.6 | 5.0 | 1.12 |

TABLE 2

| | | Fixing Property | | | | | | | | |
|---|---|---|---|---|---|---|---|---|---|---|
| | F/C | Lower limit fixing temperature (° C.) | Upper limit fixing temperature (° C.) | Cleaning ability | Charge stability | Image density | Image Granularity & Sharpness | Toner fogging | Toner scattering | Environment-Storage Stability |
| Ex. 1 | 0.051 | 140 | 210 or more | B | A | A | B | B | B | B |
| Ex. 2 | 0.012 | 135 | 210 or more | B | B | A | B | C | C | A |
| Ex. 3 | 0.034 | 140 | 210 or more | B | A | A | B | C | B | B |
| Ex. 4 | 0.054 | 140 | 210 or more | B | A | A | B | B | A | B |
| Ex. 5 | 0.048 | 150 | 190 | B | A | A | B | C | C | B |
| Ex. 6 | 0.037 | 150 | 200 | A | A | A | C | B | B | A |
| Compara. Ex. 1 | 0.000 | 140 | 210 or more | B | C | A | D | D | D | B |
| Compara. Ex. 2 | 0.009 | 140 | 210 or more | B | C | A | D | D | D | B |
| Compara. Ex. 3 | 0.130 | 160 | 170 | C | A | B | B | B | A | D |

What is claimed is:

1. A toner for developing electrostatic images comprising:

a colorant, a resin, and a fluoride compound, wherein the fluoride compound exists on the surfaces of toner particles, and the atomic number ratio (F/C) of fluoride atoms to carbon atoms existing on the surfaces of the toner particles is 0.010 to 0.054.

2. The toner for developing electrostatic images according to claim 1, wherein the toner is formed by dispersing oil droplets of an organic solvent with a toner composition containing a prepolymer dissolved therein in an aqueous medium, and subjecting the dispersion to an elongation reaction and/or a cross-linking reaction.

3. The toner for developing electrostatic images according to claim 1, wherein the toner comprises a polyester resin.

4. The toner for developing electrostatic images according to claim 1, wherein the toner comprises a modified polyester resin.

5. The toner for developing electrostatic images according to claim 1, wherein the toner comprises an unmodified polyester (ii) along with the modified polyester (i), and the weight ratio of the modified polyester (i) to the unmodified polyester (ii) is 5/95 to 80/20.

6. The toner for developing electrostatic images according to claim 1, wherein the fluoride compound is a compound represented by General Formula 1:

General Formula 1

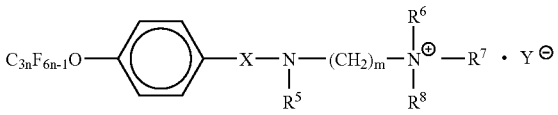

where X represents —$SO^2$— or —CO—; $R^5$, $R^6$, $R^7$, and $R^8$ is a group individually selected from the group consisting of hydrogen atoms, alkyl groups having carbon atoms of 1 to 10 and aryl groups; "m" and "n" is an integer; and Y is a halogen atom such as I, Br, and Cl.

7. The toner for developing electrostatic images according to claim 1, wherein the toner particles are formed in a substantially spherical shape with an average circularity E of 0.90 to 0.99.

8. The toner for developing electrostatic images according to claim 1, wherein the circularity SF-1 value of the toner particles is 100 to 140, and the circularity SF-2 value of the toner particles is 100 to 130.

9. The toner for developing electrostatic images according to claim 1, wherein the volume average particle diameter Dv of the toner particles is 2 μm to 7 μm, and the Dv/Dn ratio of the volume average particle diameter Dv to the number average particle diameter Dn is 1.15 or less.

10. The toner for developing electrostatic images according to claim 1, wherein the fluoride compound is contained in a content of 0.01% by weight to 5% by weight relative to the total weight of the toner.

11. A method for producing a toner for developing electrostatic images comprising:

dispersing a fluoride compound in alcohol containing water, and making the fluoride compound adhere on or bound to the surface of the toner, wherein the toner comprises a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054.

12. A two-component developer comprising:

a toner for developing electrostatic images, and a carrier which comprises magnetic particles, wherein the toner for developing electrostatic images comprises a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054.

13. An image forming apparatus comprising:

a photoconductor, a charging unit configured to charge the photoconductor, an exposing unit configured to expose the photoconductor charged by use of the charging unit with a write laser beam to form a latent electrostatic image, a developing unit with a developer loaded therein configured to develop the latent electrostatic image into a visible image by supplying the developer to the photoconductor to thereby form a toner image, and a transferring unit configured to transfer the toner image formed by use of the developing unit onto a transferring member, wherein the developer is a two-component developer which comprises a toner for developing electrostatic images and a carrier; the toner for developing electrostatic images comprises a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054; and the carrier comprises magnetic particles.

14. An image forming method comprising:

charging a photoconductor, exposing the photoconductor charged in the charging unit with a write laser beam to form a latent electrostatic image, developing the latent electrostatic image into a visible image by supplying the developer to the photoconductor to thereby form a toner image, and transferring the toner image formed in the developing onto a transferring member, wherein the developer is a two-component developer which comprises a toner for developing electrostatic images and a carrier; the toner for developing electrostatic images comprises a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054; and the carrier comprises magnetic particles.

15. The image forming method according to claim 14, wherein the transferring comprises transferring the toner image formed on the photoconductor onto an intermediate transfer member, and transferring the toner image on the intermediate transfer member onto a final transfer member.

16. A process cartridge comprising:

a photoconductor, and one or more units selected from a charging unit configured to charge the photoconductor, a developing unit with a developer loaded therein configured to develop a latent electrostatic image formed by means of exposure into a visible image by supplying the developer to the photoconductor to thereby form a toner image, and a cleaning unit configured to remove a residual toner remaining on the photoconductor after transferring, the one or more units are integrally supported so as to be detachably mounted on the main body of an image forming apparatus, wherein the developer is a two-component developer which comprises a toner for developing electrostatic images and a carrier; the toner for developing electrostatic images comprises a colorant, a resin, and a fluoride compound, the fluoride compound exists on the surfaces of toner particles, and the atomic number ratio (F/C) of fluoride atoms to carbon atoms existing on the surfaces of the toner particles is 0.010 to 0.054; and the carrier comprises magnetic particles.

* * * * *